US010390590B2

(12) United States Patent
Ben-Arie

(10) Patent No.: US 10,390,590 B2
(45) **Date of Patent: *Aug. 27, 2019**

(54) LACE RATCHETING DEVICE II

(71) Applicant: Jezekiel Ben-Arie, Carlsbad, CA (US)

(72) Inventor: Jezekiel Ben-Arie, Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/722,755

(22) Filed: Oct. 2, 2017

(65) Prior Publication Data

US 2018/0020779 A1 Jan. 25, 2018

Related U.S. Application Data

(63) Continuation-in-part of application No. 15/207,517, filed on Jul. 12, 2016, now Pat. No. 9,808,050.

(60) Provisional application No. 62/252,511, filed on Nov. 8, 2015.

(51) Int. Cl.

| | |
|---|---|
| ***A44B 11/12*** | (2006.01) |
| ***A43C 7/04*** | (2006.01) |
| ***A44B 11/14*** | (2006.01) |
| ***A43C 1/00*** | (2006.01) |
| ***A43C 7/08*** | (2006.01) |

(52) U.S. Cl.

CPC ..... *A44B 11/125* (2013.01); *A43C 1/00* (2013.01); *A43C 7/04* (2013.01); *A43C 7/08* (2013.01); *A44B 11/14* (2013.01)

(58) Field of Classification Search

CPC ..... A43C 7/04; A43C 7/08; A44B 11/125; A44B 11/14

See application file for complete search history.

(56) References Cited

U.S. PATENT DOCUMENTS

| | | | | | |
|---|---|---|---|---|---|
| 1,279,043 | A * | 9/1918 | Treadgold | A43C 7/04 | 24/712.6 |
| 1,489,117 | A * | 4/1924 | De Paye | A43C 7/00 | 24/132 R |
| 2,131,454 | A * | 9/1938 | Prestinari | A44C 5/185 | 24/265 R |
| 3,225,402 | A * | 12/1965 | Altman | A43C 7/04 | 24/134 R |
| 4,071,964 | A | 2/1978 | Vogiatzis | | |
| 4,125,918 | A | 11/1978 | Baumann | | |
| 4,130,949 | A | 12/1978 | Seidel | | |
| 4,261,081 | A | 4/1981 | Lott | | |
| 4,458,373 | A | 7/1984 | Maslow | | |

(Continued)

*Primary Examiner* — Robert Sandy
*Assistant Examiner* — David M Upchurch

(57) ABSTRACT

The Lace Ratchet Device (LRD) facilitates lace fastening and release. The LRD has two states: "active" and "inactive". In the active position the device works as a lace ratchet i.e. allowing the lace to be pulled forwards but restricting any lace motion backwards. After fastening the lace remains fastened until the LRD is switched into inactive state by manually pressing a lever. Each LRD has a turning gate rotatably installed in a channel with front end with sharp edge. A preloaded spring keeps the LRD in active position when the lever is not pressed. The LRD doesn't employ serrated surfaces, which cause accelerated lace wear. Instead, the LRD's smooth front edge side and channel surfaces minimize lace wear. Parallel and triangular configurations of LRD pairs facilitate lace fastening of footwear. Single LRDs can be used for fastening of garments and other objects.

22 Claims, 32 Drawing Sheets

(56) References Cited

U.S. PATENT DOCUMENTS 4,507,878 A 4/1985 Semouha
4,616,432 A 10/1986 Bunch
4,648,159 A 3/1987 Dougherty
4,991,273 A 2/1991 Huttle
5,001,847 A 3/1991 Waters
5,097,573 A 3/1992 Gimeno
5,109,581 A 5/1992 Gould
5,119,539 A 6/1992 Curry
5,177,882 A 1/1993 Berger
5,203,053 A 4/1993 Rudd
5,230,171 A 7/1993 Cardaropoli
5,293,669 A 3/1994 Sampson
5,293,675 A 3/1994 Shai
5,295,315 A 3/1994 Osawa
5,335,401 A 8/1994 Hanson
5,467,511 A 11/1995 Kubo
5,477,593 A 12/1995 Leick
5,572,774 A 11/1996 Duran
5,572,777 A 11/1996 Shelton
6,049,950 A * 4/2000 Cavallo ..... F16G 11/101 24/170
6,076,241 A 6/2000 Borel
6,094,787 A 8/2000 Chang
6,192,241 B1 2/2001 Yu
6,192,559 B1 2/2001 Munsell
6,282,817 B1 9/2001 Curet
6,334,240 B1 1/2002 Li
6,339,867 B1 1/2002 Azam
6,438,871 B1 8/2002 Culverwell
6,588,079 B1 7/2003 Manzano
6,622,358 B1 9/2003 Christy
6,729,000 B1 * 5/2004 Liu ..... A43C 3/04 24/132 WL
6,735,829 B2 5/2004 Hsu
6,938,308 B2 9/2005 Funk
7,082,701 B2 8/2006 Dalgaard
7,152,285 B2 12/2006 Liao
7,313,849 B2 1/2008 Liu
7,320,161 B2 1/2008 Taylor
7,360,282 B2 4/2008 Borsoi
7,591,050 B2 9/2009 Hammerslag
7,681,289 B2 3/2010 Liu
8,046,937 B2 11/2011 Beers
8,141,273 B2 * 3/2012 Stramare ..... A43C 7/08 24/134 P
8,230,560 B2 7/2012 Luzlbauer
8,231,074 B2 7/2012 Hu
8,332,994 B2 12/2012 Lin
8,371,004 B2 2/2013 Huber
8,381,362 B2 2/2013 Hammerslag
9,185,948 B2 11/2015 Ben-Arie
2002/0002781 A1 1/2002 Bouirer
2003/0070269 A1 * 4/2003 Chung ..... A43C 3/00 24/714.6
2003/0226284 A1 12/2003 Grande
2004/0148741 A1 * 8/2004 Hsiao ..... A43C 11/1406 24/68 SK
2004/0226189 A1 * 11/2004 Semitka ..... A43C 3/00 36/50.5
2005/0005477 A1 1/2005 Borsoi
2006/0213085 A1 9/2006 Azam
2007/0169380 A1 7/2007 Borsoi
2008/0250618 A1 10/2008 Stramare
2009/0172929 A1 7/2009 Hwang
2010/0115744 A1 5/2010 Fong
2011/0067211 A1 * 3/2011 Huber ..... A43B 5/0401 24/712.1
2011/0094072 A1 * 4/2011 Lin ..... A43C 1/00 24/712.6
2013/0160256 A1 * 6/2013 Waldman ..... A43C 7/04 24/712.6
2014/0208551 A1 * 7/2014 Ben-Arie ..... A43C 7/04 24/712.9
2015/0216264 A1 * 8/2015 Kim ..... A43C 7/00 24/712.7
2016/0374432 A1 * 12/2016 Park ..... A43C 7/00 24/324

* cited by examiner

LACE RATCHETING DEVICE II

CROSS-REFERENCE TO RELATED APPLICATIONS

This Application is Continuation In Part of application Ser. No. 15/207,517 Filed on Jul. 12, 2016.

In addition, this application claims the priority of Provisional Patent Application Ser. No. 62/252,511, Filed: Nov. 8, 2015 (via Continuation In Part of Ser. No. 15/207,517 Filed on: Jul. 12, 2016).

FEDERALLY SPONSORED RESEARCH

Not Applicable

SEQUENCE LISTING OR PROGRAM

Not Applicable

FIELD OF THE INVENTION

The invention is related to devices for fastening and keeping fastened laces, chords, ropes, strings and alike.

BACKGROUND OF THE INVENTION—PRIOR ART

Many devices were invented for shoe lace tightening. The most commercially successful is U.S. Pat. No. 6,339,867 by Azam which is widely used in fastening laces of skiing and skates boots. The tightening principle is a spring loaded gear wheel which can move in wedge shaped passage which widens forwards and narrows backwards. The laces pass through that passage and can be fastened by pulling the laces forwards which in turn pulls forwards the gear wheel towards the wider part of the passage where the laces are free to move. When the pulling stops the laces pull the gear wheel backwards, which narrows the passage and blocks the laces' backwards motion. The laces can be released by pulling the gearwheel forwards with a knob. There are few noticeable disadvantages to this popular invention. The device must be installed on heavy-solid footwear which eliminates its use with regular shoes and the user must constantly pull the knob to keep the releasing. In addition, the teeth of gearwheel and opposite teeth cause severe lace wear. Similar approach is taken in U.S. Pat. No. 7,360,282 by Borsoi and in U.S. Pat. No. 8,141,273 by Stramare. The lace buckle device described in U.S. Pat. No. 6,334,240 by Li is used widely in coat laces. It has a lace passage controlled by a spring loaded piston that blocks lace motion when the spring is released. Except for the similar name there is no similarity to our invention. This buckle controls only one lace and does not have a ratchet operation at all. When the user wants to release or fasten the lace the user has to press the spring loaded piston, release the lace and pull at the same time. When the spring is released, the buckle returns to b the lace. Similar devices are sold as "shoe buckles" for fastening shoe laces. The main disadvantage of such shoe buckles is that they do not have a ratcheting operation, which enables one to fasten the laces just by pulling. The shoe buckles require one to fasten the laces with one hand while keeping the buckle in position with the other hand and then switching the buckle into position. This results in cumbersome and inefficient fastening.

In U.S. Pat. No. 6,729,000 Liu uses for lace tightening a teethed rotating bar. In U.S. Pat. No. 6,076,241 by Borel and in several others such as in U.S. Pat. No. 6,622,358 to Christy and in U.S. Pat. No. 6,192,241 by Yu et al. use fastening devices which are based on pipes or channels which have diagonal teeth to block reverse motion of the lace. The pipes are installed on the shoes in different locations.

In U.S. Pat. No. 8,371,004 Huber teaches a lace mechanism. Huber's mechanism employs a pair of spring loaded pivoted arms which have sets of sharp teeth that when pressed against the laces block their motion in both directions. Thus, Huber's mechanism is not a lace ratchet mechanism because it does not allow further lace tightening once it is. In its state, the laces are released in both directions simply by pressing the arms of Huber's mechanism. Huber's mechanism is impractical because the sharp teeth tend to cause a lot of lace wear when the laces are fastened before. Huber's mechanism structure is complex and expensive to manufacture. In addition, similar to the lace buckle, the user needs to fasten both laces with one hand while pressing the arms with the second hand to keep the mechanism in position. In U.S. Pat. No. 8,332,994 Jih-Liang Lin teaches a shoe lace fastener which fasten the lace using jagged arm on top and jagged base on bottom. The device structure includes many complex parts and is expensive to manufacture. Such a structure also is impractical because it will wear the lace very quickly. In U.S. Pat. No. 8,381,362 to Hammerslag et al. teaches Real based closure system. U.S. Pat. No. 8,332,994 to Lin teaches Shoelace with shoelace fastener. U.S. Pat. No. 8,141,273 to Stramare et al. describes Shoes with directional conditioning device for laces. U.S. Pat. No. 8,231,074 to Hu et al. describes Lace winding device for shoes. U.S. Pat. No. 8,230,560 to Luzlbauer teaches Fastening system for shoes.

U.S. Pat. No. 9,185,948 to Ben-Arie describes a Buckle Lace Fastening Device (BLFD) which also enables lace ratcheting. However, the BLFD is using resilient gates which do not rotate but bend. In addition, the mechanism of the BLFD, which is based on rotating the gripping wall is entirely different from the mechanism of the current invention.

U.S. Pat. No. 8,046,937 to Beers et al. describes an Automatic lacing system. U.S. Pat. No. 7,681,289 to Liu describes a Fastener for fasting together two lace systems. U.S. Pat. No. 7,591,050 to Hammerslag describes a Footwear lacing system. U.S. Pat. No. 7,320,161 to Taylor describes a Lace tying device. U.S. Pat. No. 7,313,849 to Liu describes a Fastener for lace. U.S. Pat. No. 7,152,285 to Liao describes a Shoe lace fastening device. U.S. Pat. No. 7,082,701 to Dalgaard describes Footwear variable tension lacing systems. U.S. Pat. No. 6,938,308 Funk describes a lace securing and adjusting device. U.S. Pat. No. 6,735,829 Hsu describes a U shaped lace buckle. In U.S. Pat. No. 6,588,079 to Manzano describes a Shoelace fastening assembly. U.S. Pat. No. 6,438,871 to Culverwell describes Footwear fastening. U.S. Pat. No. 6,192,559 to Munsell Jr. describes a Shoelace fastening apparatus. U.S. Pat. No. 6,094,787 to Chang describes a Fastening device. U.S. Pat. No. 5,572,777 to Shelton describes a Shoelace tightening device. U.S. Pat. No. 5,572,774 to Duren teaches a Shoe fastening attached device. U.S. Pat. No. 5,467,511 to Kubo describes a Shoelace fastening device. U.S. Pat. No. 5,335,401 to Hanson teaches a Shoelace tightening and device. U.S. Pat. No. 5,295,315 to Osawa et al. describes a Shoe fastening device and plate shaped member thereof. U.S. Pat. No. 5,293,675 to Shai describes a Fastener for shoelace. U.S. Pat. No. 5,293,669 to Sampson teaches a Multiuse fastener system. U.S. Pat. No. 5,230,171 to Cardaropoli teaches a Shoe fastener.

U.S. Pat. No. 5,203,053 to Rudd teaches a Shoe fastening device. U.S. Pat. No. 5,177,882 to Berger teaches a Shoe with central fastener. U.S. Pat. No. 5,119,539 to Curry teaches a Lace fastener. U.S. Pat. No. 5,109,581 to Gould teaches a Device and method for securing a shoe. U.S. Pat. No. 4,991,273 to Huttle teaches Shoe lace fastening. U.S. Pat. No. 4,648,159 to Dougherty teaches a Fastener for lace or rope or the like. U.S. Pat. No. 4,616,432 to Bunch et al. teaches a Shoe upper with lateral fastening arrangement. U.S. Pat. No. 4,507,878 to Semouha teaches a Fastener mechanism. U.S. Pat. No. 4,458,373 to Maslow teaches Laced shoe and method for tying shoelaces. U.S. Pat. No. 4,261,081 to Lott teaches a Shoelace tightener. U.S. Pat. No. 4,130,949 to Seidel teaches Fastening means for sports shoes. U.S. Pat. No. 4,125,918 to Baumann teaches a Fastener for lace shoes. U.S. Pat. No. 4,071,964 to Vogiatzis teaches a Footwear fastening system. U.S. Pat. No. 5,097,573 to Gimeno teaches Fastening Device for Lace Up Shoes. U.S. Pat. No. 5,001,847 to Waters teaches a Lace Fastener. U.S. Pat. No. 5,477,593 to Leick teaches a Lace Device. U.S. Pat. No. 6,282,817 to Curet teaches an Apparatus and Method for Lacing.

US Patent Applications

In US 2011/0094072 to Lin describes a Shoelace with Shoelace Fastener. In US 2010/0115744 to Fong describes a Lace Fastener. In US 2009/0172929 to Huang describes a Device for tying Shoe laces. In US 2008/025068 to Stramare describes a Shoe with Directional Conditioning Device for lace or the like. In US 2007/0169380 to Borsoi teaches a Device for B Flexible Strands. In US 2006/0213085 to Azam teaches an Article for Footware with Linkage Tightening Device. In US 2005/0005477 to Borsoi teaches a Lace B Device. In US 2003/0226284 to Grande teaches a Lacing System For Skates. In US 2002/0002781 to Bourier teaches a Lace Tightening Device Having a Pocket for Storing a B Element.

BRIEF SUMMARY OF THE INVENTION

In conclusion, all the above inventions do not propose a Lace Fastening Device which combines all of the following desired properties which we introduced into our invention:

1. The device enables users to fasten regular laces by a ratchet operation, i.e. the user has just to pull the lace and the lace remains fully fastened after the pulling stops until the user releases it.
2. The lace can be released easily and quickly by the user.
3. The device has a simple structure, which is suited for low cost manufacturing.
4. Repeated use of the device causes minimal lace wear.
5. The device can fasten any standard lace and can be easily installed on footwear, garments or other objects.

The invention includes various lace ratcheting configurations of a basic lace ratcheting device. These configurations facilitate easy fastening and keeping fastened of: laces, ropes, strings and alike. The basic Lace Ratcheting Device (LRD) is small in dimensions and can be installed on shoes or on other objects which need fastening of laces, ropes, strings and alike. The LRD can be used to fasten laces simply by inserting the laces into LRDs and pulling them. The LRD has a self locking ratcheting mechanism with two states: "active" and "inactive". In the active state the device works as a lace ratchet i.e. allowing the lace to be pulled forwards but blocks or severely restricts any lace motion backwards. After the user has fastened the laces they remain fastened until the mechanism is switched into an inactive state. Each LRD has a channel for fastening one lace. In one embodiment of the LRD, the channel comprises of four walls: a gripping wall, a top wall opposite to the gripping wall, a lower side wall approximately normal to the gripping wall and an upper side wall opposite to the lower side wall. A turning gate (made of solid material) is rotatably installed on a fulcrum i.e. an axle fitted into a bearing within the channel. The axle is centered at the turning gate's axis of rotation. The turning gate comprises of a front end and a rear end wherein the axis of rotation is situated between the two ends. The front end is opposite the gripping wall and there is a gap between the front end and the gripping wall. The lace is passing through the gap. The turning gate's rear end serves as a lever. In one embodiment, a preloaded helical torsion spring is mounted on the axle. In other embodiments one could use other kinds of springs. The spring is installed preloaded with a bias which tends to turn the gate in backwards direction i.e. towards an active state in which the front end applies pressure force on the lace which is squeezed in the gap against the gripping wall. Thus, the regular state of the turning gate is in active state and it is switched into inactive state only when the user applies manual pressure on the lever, which exceeds the bias and turns the turning gate forwards, thus releasing the pressure force the front end applies on the lace in the gap. The turning gate has a front end which has a single tapered edge i.e. sharp edge with a smooth side i.e. the front end is tapered i.e. sharp and has a smooth side. The lace passes through a gap between the front end of the turning gate and the channel's gripping wall situated opposite to the front end of the turning gate. The gap width is controlled by a ratcheting mechanism operated by the lever.

When the ratcheting mechanism is in the active state, the gap is narrowed such that the turning gate applies a pressure force which is squeezing the lace in the channel with its tapered i.e. sharp edge and acts as a lace ratchet. It means that the turning gate allows forwards fastening motion of the lace but blocks or severely restricts any lace translation in backwards direction. In order to have a ratchet operation, the turning gate is installed in a forwards leaning diagonal orientation in the channel such that its front end is closer to the gripping wall then its axis of rotation. Also, in a forwards leaning diagonal orientation, the turning gate's front end is closer to the channel's exit than the turning gate's axis of rotation. The ratchet operation of the gate stems from the forward leaning diagonal orientation of the turning gate, which allows forwards lace motion when the lace is moved forwards. Moving forwards the lace which is squeezed in the gap, drags the turning gate's front end forwards due to the friction force which exists between the lace and the front end because of the pressure force applied by the front end on the lace. When the front end moves forwards also the turning gate turns forwards as well. Due to the forwards leaning diagonal state of the turning gate, when its front end is moved forwards it also moves laterally inwards i.e. away from its gripping wall, thus increasing the width of the gap between the front end and its gripping wall which results in diminished pressure force of the front end on the lace. Reduced pressure force on the lace results in reduced friction between the lace and the surface of the gripping wall and also reduced friction between the lace and the front end and enabling (facilitating) even easier forwards motion of the lace.

On the other hand, if the lace moves backwards it also drags the turning gate's front end backwards since the front end is squeezing the lace and has a mutual friction force with the lace. When the front end moves backwards also the turning gate turns backwards as well. Due to the forwards leaning diagonal orientation of the gate, the motion backwards of the front end has also a lateral outwards component which moves the front end towards the gripping wall thus further narrowing the gap which increases the pressure force of the pront end on the lace and further restricting backwards lace motion. Thus, in an active state the gate acts as a lace ratchet i.e. allows lace forwards motion but blocks lace's backwards motion. When the ratcheting mechanism is switched into inactive state, the gap is widened more than the lace's width the pressure force of the front end on the lace is diminished and the lace is entirely released because it can move freely forwards or backwards in the channel. The user can easily switch the ratcheting mechanism from active to inactive state simply by manually pressing on the lever, which is the rear end of the turning gate. If the manual pressure is greater than the torsion spring's preloading bias, the gate turns forwards and increases the gap's width, thus inactivating the LRD. When the manual pressure ceases the preloaded torsion spring turns the gate backwards into an active state. The LRD can be manufactured at low cost because it has a simple structure with only few parts.

The LRD's structure is different from other lace fastening devices in few important aspects. Primarily, the LRD enables a lace ratcheting operation which is self locking it means that in the blocked state pulling the blocked lace with more force, only increases also the blocking force. In addition, our LRD was configured to employ a ratcheting mechanism which causes only minimal wear of the lace since it employs in the channel a novel structure with a diagonally forwards leaning rotating gate with a single tapered i.e. sharp front end which has a smooth side. When the lace is moved forwards, the tapered i.e. sharp edge at the front end of the turning gate rotates forwards this also turns the smooth side of the tapered i.e. sharp edge to be approximately parallel with the lace and the lace is sliding on the smooth side of the tapered i.e. sharp edge—which does not wear the lace. At the same time, the forwards rotation also widens the gap and reduces lace friction and wear while the lace is moved forwards. Since the lace is blocked from moving backwards, there is no lace wear in the backwards motion as well. In addition, the LRD's gripping wall is manufactured with a smooth surface to minimize lace wear when it moves in the gap as well. In contrast, other lace fastening devices employ gates with serrated surfaces and/or with sharp teeth structures to block lace movement in their blocked state. However, sharp teeth structures cause significant lace wear even when they are in their unblocked state since their teeth remain pointed at the lace and the lace still touches them as it moves even in a wider gap.

A pair of LRDs in a parallel configuration can be used as a shoe "Ratchet Buckle", which is not attached to the shoe but enables fastening two ends of each shoe lace. The LRDs are attached to one another in a parallel configuration of their channels by attaching the LRDs at their gripping walls. Such a shoe buckle, which is not attached to the shoe, enables easy fastening and releasing of the shoe laces. The two gate levers of the turning gates protrude from openings in the channels' top walls, on the two sides of LRD's parallel configuration. This enables the user to unlock both LRDs easily by pressing the levers with two fingers of one hand. To eliminate the protruding gate levers, two LRDs can be used as a "Ratchet Buckle" also in a triangular configuration. In the triangular configuration, the two gripping walls form the two sides of a triangle and the two levers, which protrude from openings in the top walls are touching one another at the triangle's center. The two channels are hinged to a small connecting plate and are free to turn one LRD with respect to the other LRD. The user can unlock both LRDs easily by pressing on the gripping walls on both sides of the triangular configuration. This causes the channels to rotate one towards the other and at the same time to press the gate levers which are facing one another. The triangular configuration has the advantage that it has more elegant look since it does not have protruding gate levers.

Both of the "Ratchet Buckle" structures of the parallel configuration and triangular configuration of two LRDs is designed to lie flat on top of the shoe when the laces are fastened. Each of the channels at the entry opening has a recess at the lower side wall. Each of the channels at entry opening also has a rear segment of the lower side wall next to and behind the recess. The laces are inserted into the channel via the recesses. When the lace is fastened on the shoe, the lace applies a downwards force on the recess. The downwards force is countered by a natural reaction upwards force which is applied on the rear segment by the shoe. The downwards force and the reaction upwards force create a moment of force which tends to turn the LRD towards the shoe. Hence, the moment of force clutches the LRD onto the top the shoe.

In another lacing configuration, two single LRDs can be attached to the two sides of each shoe for fastening of two lace ends of the same lace. A single LRD can also be used to fasten laces of trousers or coats simply by tying one lace end to the LRD and using the LRD to fasten the other lace's end. All the LRD configurations described above can be implemented by LRDs with helical torsion springs made from elastic material wires which have two wire ends. The rear support LRD has a channel attached pin which supports one wire end at the rear side of the turning gate while the second wire end is supported by the turning gate. The front support LRD has a channel's top wall support which supports one wire end at the front side of the turning gate while the second wire end is supported by the turning gate.

The LRD has many advantages over previous devices primarily due to its efficient and easy fastening operation by a ratchet mechanism which requires the user just to pull the lace. An important advantage of the LRD is its self locking ratcheting mechanism it means that in the blocked state pulling the blocked lace with more force, only increases also the blocking force. This prevents the lace from slipping. Once the lace is pulled, it remains fastened until the ratcheting mechanism is switched from active state into inactive state whereby it disables the ratchet mechanism and releases the lace. Another advantage of the LRD is the ability to switch the ratcheting mechanisms of two LRDs in parallel configuration and also in triangular configuration from active state into inactive state simply by squeezing the two opposite gate levers using just two fingers of one hand. Additional advantage over all the other lace ratchets is that is does not block the lace using jagged surfaces. Handling laces with devices which have jagged surfaces, which have sharp teeth, as all other lace fasteners do, results is fast wear of the laces. The diagonal orientation of the tapered i.e. sharp edges at the front ends of the turning gates in the LRDs, cause very little lace wear because each tapered i.e. sharp edge has a smooth side on which the lace can slide when it is fastened. The LRD was worn and tested daily by the Applicant for more than a year on various shoes without any noticeable lace wear.

BRIEF DESCRIPTION OF THE DRAWINGS

FIGS. 1 and 2 describe a LRD embodiment with torsion spring which has a rear support.

FIGS. 23 and 24 show the lace sliding on the smooth sides of the tapered i.e. sharp edges of gates of LRDs with rear and front spring support respectively.

DETAILED DESCRIPTION OF THE DRAWINGS

Figure 1:
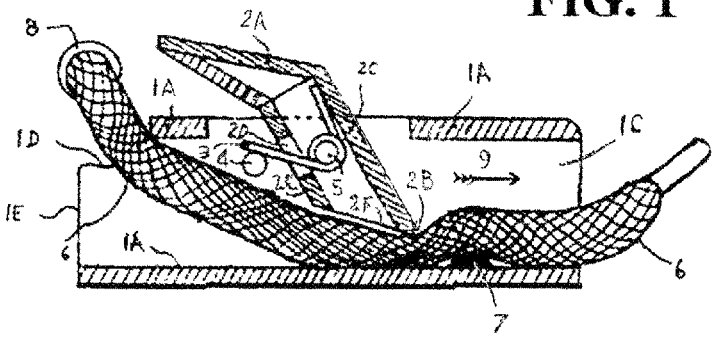
FIGS. 1 and 2 illustrate projections of cross sections of an embodiment of a LRD with its ratcheting mechanism in active and inactive states respectively.
Figure 2:
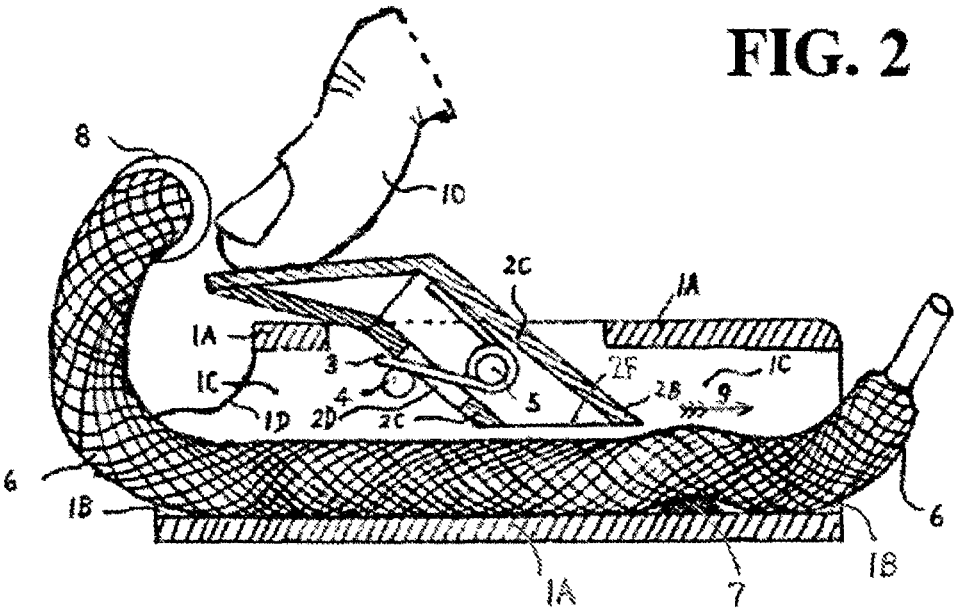

FIGS. 1 and 2 illustrate projections of cross sections of an embodiment of a rear supported spring LRD with ratcheting mechanisms in active and inactive states respectively. The LRD's housing 1A provides the walls for the channel 1C which houses the turning Gate 2C which is mounted on an axle 5. The channel 1C also houses the lace 6. The turning gate 2C is mounted on axle 5. Also mounted on the axle a helical torsion spring 3 which has a bias that tends to rotate the turning gate 1C in backwards turning direction (clockwise direction). Backwards turning moves the turning gate 2C into an active state of the ratcheting mechanism. The turning Gate 2C in FIG. 1 which is in a active state squeezes the lace 6 in the Gap between the Gate's tapered i.e. sharp edge at the front end 2B and the channel's gripping wall 1B. In FIG. 2 the turning Gate 2C is in inactive state because the Gate 2C is turned in counterclockwise direction (also called forwards turning) and the Gap between the Gate's tapered i.e. sharp edge at the front end 2B and its gripping wall 1B is wider than the width of lace 6. As shown in FIG. 2, the user has been switching the ratcheting mechanism into an inactive state. This is being done by turning forwards the turning Gate 2C into an inactive state by pressing downwards on the lever 2A with the user's finger 10. To enable the inactivation operation, the lever 2A protrudes from the channel's 1C top wall 1A. As can be observed in FIGS. 1, 2 the turning Gate 2C is in a forwards leaning diagonal orientation in the channel 1C such that its front end 2B is closer to the gripping wall 1B then its axis of rotation centered at axle 5. Also, in a forward leaning diagonal orientation, the turning gate's tapered i.e. sharp edge at front end 2B is closer to the channel's exit than the turning gate's axis of rotation centered at axle 5. The forward direction arrow 9 is pointed towards the channel's exit. The ratchet operation of the turning gate 2C stems from the forward leaning diagonal orientation of the turning gate, which allows forward lace 6 motion (to the right) when the lace is moved forwards and at the same time, drags the gate's front end 2B forwards due to mutual friction between the lace 6 and the front end 2B. Because of the diagonal orientation of the gate 2C, when its front end 2B moves forwards (i.e. in the arrow 9 direction) it also moves laterally inwards i.e. away from its gripping wall 1B, thus increasing the width of the gap between the front end 2B and its gripping wall 1B and enabling even easier forward motion of the lace. The LRD structure is designed to minimize lace wear. For this reason the gripping wall 1B surface and the smooth side 2F of the tapered i.e. sharp edge at the front end 2B are smoothed. When the lace 6 is being fastened i.e. moved in forwards direction and causing the turning gate to turn forwards, the turning gate turns the tapered i.e. sharp edge at the front end 1B away from the lace and the lace slides on the smooth side 2F of the tapered i.e. sharp edge at the front end 2B and on the smoothed surface of the gripping wall 1B with minimal wear.

On the other hand, if the lace moves backwards (i.e. opposite to the arrow 9 direction) it also drags the gate's front end 2B backwards due to mutual friction between the lace 6 and the front end 2B. Due to the diagonal orientation of the gate, the motion backwards has also a lateral outwards component which moves the front end 2B towards the gripping wall 1B thus further narrowing the gap and blocking further backwards lace motion. This effect is called "self locking mechanism" where increasing the pulling backwards force which is applied on the lace 6, also increases the blocking force of the LRD. Thus, in an active state the gate acts as a lace ratchet i.e. allows lace forwards motion but blocks backwards motion. When the ratcheting mechanism is switched into inactive state the gap is widened enough such that the lace is entirely released because it can move freely forwards or backwards in the channel. The ratcheting mechanism can be switched from active to inactive state by manually pressing at lever 2A attached to each gate and rotating the gate forwards (i.e. in counterclockwise direction in FIGS. 1 and 2). The manual pressure in FIG. 2 is applied by the user's finger 10. When the manual pressure ceases the preloaded spring 3 rotates the turning gate 2C backwards (i.e. in clockwise direction in FIGS. 1 and 2) into an active state.

In the Gate's 2C forward leaning diagonal orientation, pulling the lace 6 in forwards direction (to the right) which is denoted by the arrow 9, due to mutual Gate-lace friction causes the Gate's front end 2B to move in a combined forwards and laterally inwards motion (i.e. moving upwards and away from the gripping wall 1B) motion. The lateral inwards movement increases the width of the Gap and also turns the tapered i.e. sharp edge at the front end 2B away from the lace 6, thus allowing the lace to move forwards more easily with less friction and wear because it slides on the smooth side 2F and on the smoothed gripping wall 1B. On the other hand, pulling the lace 6 in backwards direction (to the left) which is opposite to the arrow 9, causes the turning Gate's front end 2B to move in a combined backwards and laterally outwards motion (i.e. moving towards the gripping wall 1B). The laterally outwards movement reduces the width of the Gap, thus squeezing the lace even harder therefore preventing the lace to move further backwards. The bulge 7 which is installed on the gripping wall 1B, increases the b force of the turning Gate 2C by forcing the lace to bend when the front end 2B squeezes it. Both the gripping wall 1B and the bulge 7 have smooth surfaces to minimize the wear of the lace passing in the gap.

The helical torsion spring 3 which is mounted on the axle 5 is preloaded and has a bias which constantly pushes the turning Gate 1C to turn backwards (i.e. in clockwise direction in FIG. 1). Thus, the spring 3 keeps the LRD in an active state when the user is not pressing on the lever 2A. To switch the Gate's ratcheting mechanism into an inactive state, the user's finger 10 has to press the Gate's lever 2A downwards overcoming the spring's 3 bias. The helical torsion spring 3 has two wire ends one wire end exits the turning gate via opening 2D and is supported by rear pin 4. The rear pin 4 was attached to the channel 1C to support the spring's 3 wire end, i.e. to provide rear support to the spring. The other wire end of the spring is supported by the turning gate's wall. In FIG. 1 the lace 6 exits the shoe's eyelet 8 and enters the channel 1C. The lace 6 in FIG. 1 is fastened and enters the channel 1C via the recess 1D in the lower side wall. The downwards pressure of the fastened lace 6 on the recess 1D in the lower side wall and the upwards reaction pressure of the shoe on the channel's rear segment 1E of the lower side wall create a moment force which forces the LRD to rotate downwards, thus clutching the LRD flat on top of the shoe. The lever 2A protrudes from an opening in the top wall 1A.

Figure 3:
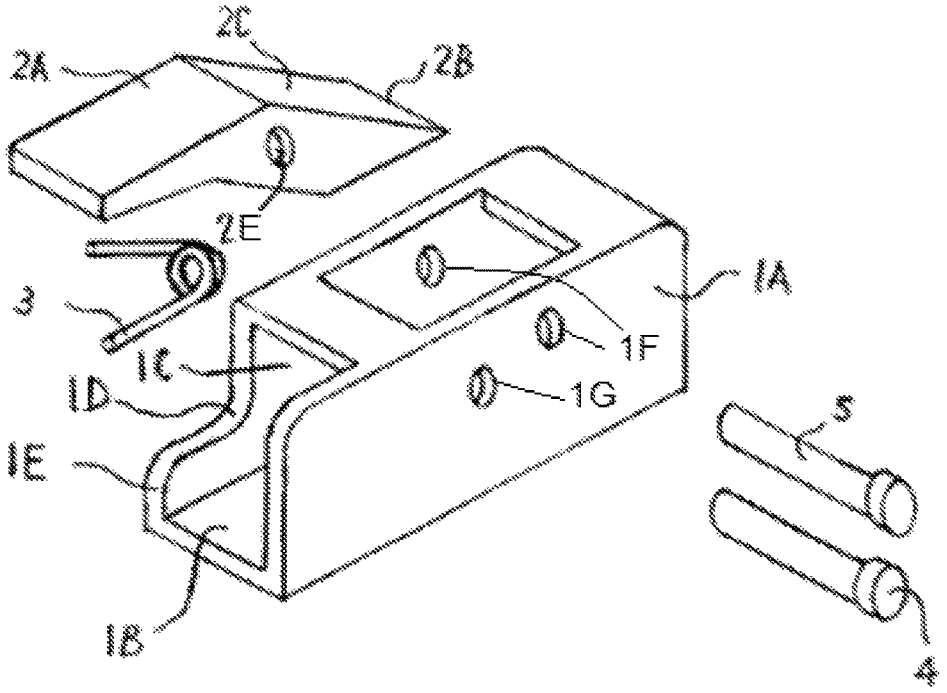
FIG. 3 shows a blow up 3D isometric drawing of the parts of a rear spring support embodiment of a disassembled LRD. The parts' orientations correspond to their actual orientations in the assembled LRD.

FIG. 3 shows a blow up 3D isometric drawing of the parts of an embodiment of a disassembled LRD with rear spring support. The parts' orientations correspond to their actual orientations in the assembled LRD. Pin 5 serves as an axle to the turning Gate 2C. The turning gate 2C is shown with its front end 2B and its lever 2A. Hole 2E which serves as a bearing for axle 5 is not denoted in FIGS. 1 and 2 to prevent overcrowding. Opening 2D which serves as a passage for the spring's 3 arm in the rotating gate, is shown only in FIGS. 1, 2, 7 due to its rear side location, which is not shown in FIG. 3. Rear pin 4, which is riveted to the housing 1A in holes 1G serves as a rear support for the spring 3. The axle 5 is riveted to the LRD housing 1A at holes 1F.

Figure 4:
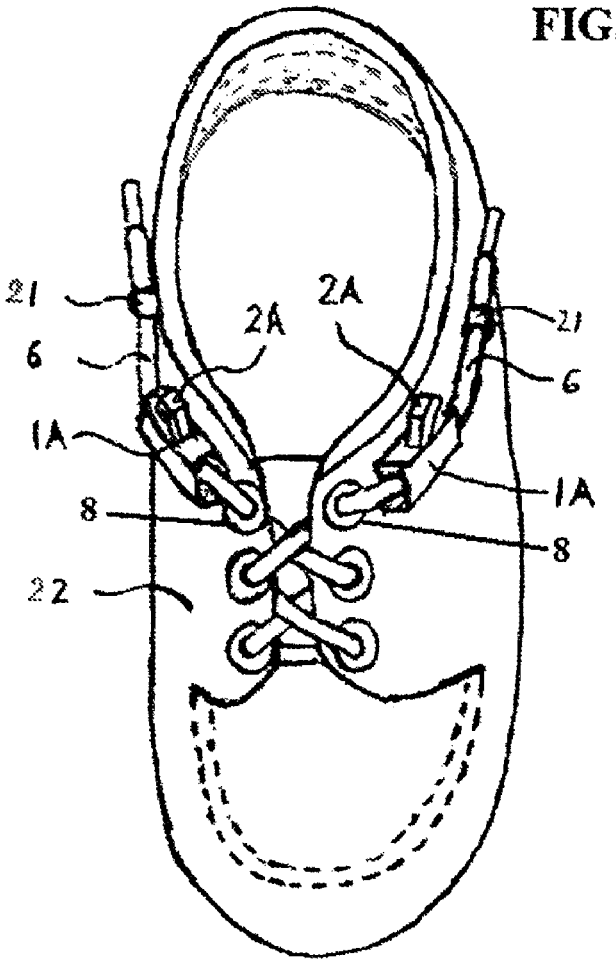
FIG. 4 describes two rear spring support embodiments of a LRD, which are installed on two sides of a shoe for lace fastening.

FIG. 4 describes two LRDs 1A which are installed on a shoe's top 22. The laces 6 which exit the eyelets 8, enter the LRDs 1A and are fastened backwards. The hooks 21 serve as lace end holders to prevent lace dangling.

Figure 5:
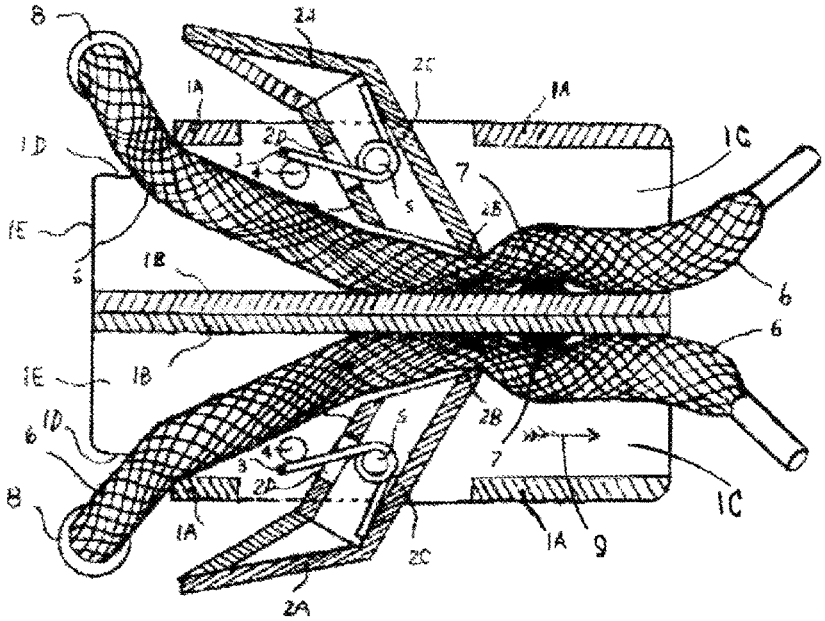
FIG. 5 shows a cross section projection drawing of a pair of rear spring support LRDs (named in the claims as lace ratcheting system) which are attached to one another in a parallel configuration as a "Ratchet Buckle". The ratcheting mechanisms of the LRDs in FIG. 5 are in active state.
Figure 6:
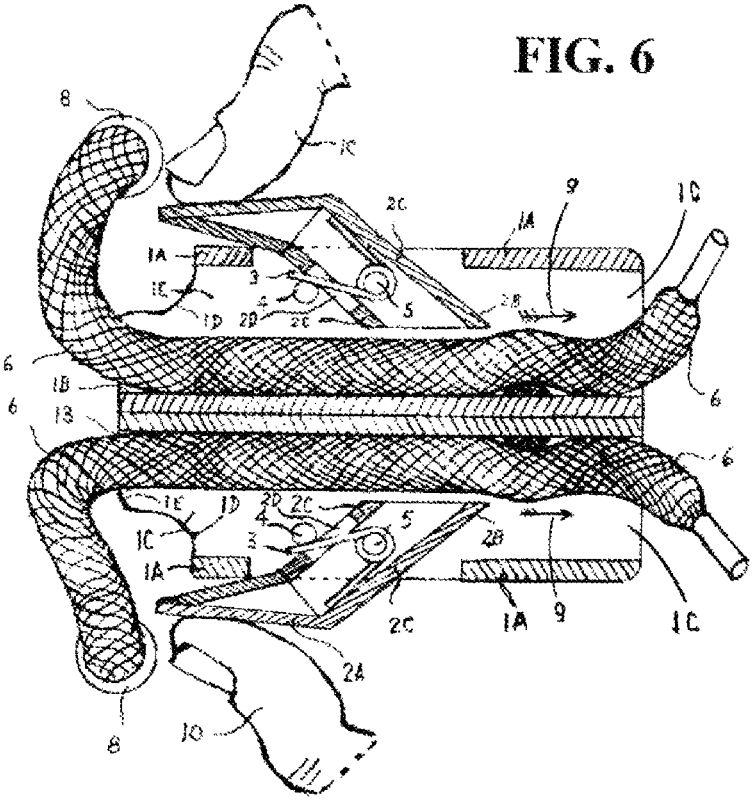
FIG. 6 shows a cross section projection drawing of a pair of rear spring support LRDs which are attached to one another in a parallel configuration as a "Ratchet Buckle". The ratcheting mechanisms of the LRDs in FIG. 6 are in inactive state.

FIG. 5 depicts a cross section drawing of a pair of rear support LRDs which are attached to one another in a parallel configuration. The ratcheting mechanisms of these LRDs are in active states and the laces 6 are fastened. The LRDs' housing 1A provides the walls for the channels 1C which house the turning Gates 2C which are mounted on axles 5. Each of the channels 1C also house a lace 6. The turning Gates 2C in FIG. 5 which are in active states squeeze the laces 6 in the Gaps between the Gates' front ends 2B and the channels' gripping walls 1B. In FIG. 6 the turning Gates 2C are in inactive states because the Gates 2C are rotated in forwards turning direction and the Gap between the Gates' tapered i.e. sharp edges at their front ends 2B and their gripping walls 1B is wider than the widths of laces 6. As shown in FIG. 6, the user has been switching the ratcheting mechanism into inactive states by applying manual pressure on the levers 2A by fingers 10. This is being done by rotating forwards the turning Gates 2C into inactive states by pressing on the levers 2A with the users' fingers 10. As can be observed in FIG. 5, the turning Gates 2C are in a forward leaning diagonal orientations. In these orientations pulling the laces 6 in forwards direction (to the right) which is denoted by the arrows 9, causes the Gates' front end to move in a combined forwards and laterally inwards motion (i.e. moving away from their gripping walls 1B) motion. The lateral inwards movements increase the widths of the Gaps and also turns the tapered i.e. sharp edges at their front ends 2B away from the laces 6, thus allowing the laces to move forwards more easily with less friction and wear. On the other hand, pulling the laces 6 in backwards directions (to the left) which is opposite to the arrows 9, causes the turning Gates' front ends to move in a combined backwards and laterally outwards motions (i.e. moving towards the gripping walls 1B). The laterally outwards movements reduce the widths of the Gaps, thus squeezing the laces even harder therefore preventing the laces to move further backwards. The bulges 7 which are installed on the gripping walls 1B, increase the blocking force of the turning Gates 2C even further by forcing the laces to bend when the front ends 2B squeezes them. Both the gripping walls 1B and the bulges 7 have smooth surfaces to minimize the wear of the lace passing in the gap.

In FIGS. 5 and 6 the helical torsion springs 3 which are mounted on the axles 5 are preloaded and have a bias which constantly pushes the turning Gates 1C to turn backwards. Thus, the springs 3 keep the LRDs in an active state when the user is not pressing on the gate levers 2A. To switch the Gates' ratcheting mechanisms into inactive states, the user 10 has to press the levers 2A (which protrude from the channels' top walls on both sides of the parallel configuration) overcoming the springs' 3 biases—as shown in FIG. 6. The rear pins 4 were placed to support the springs' 3 first wire ends and provide rear spring supports. The second wire ends of the springs is supported by the turning gates' walls. In FIG. 5 the laces 6 exit the shoe's eyelets 8 and enter the channels 1C. The laces 6 in FIG. 5 are fastened and enter the channels 1C via the recesses 1D in the lower side walls which are situated at the lower sides walls of the entrances of the channels 1C. The downwards pressure of the fastened laces 6 on the recesses 1D create as a reaction an equal counter upwards pressure of the shoe on the channels' entrance rear segment 1E of the lower side wall next to and behind the recesses 1D. The downwards pressure coupled with the upwards pressure generate a rotating moment of force which tends to press the lower side walls of the LRDs parallel configuration against the top part of the shoe. Whereby, keeping the LRDs parallel configuration pressed flat on top of the shoe.

Figure 7:
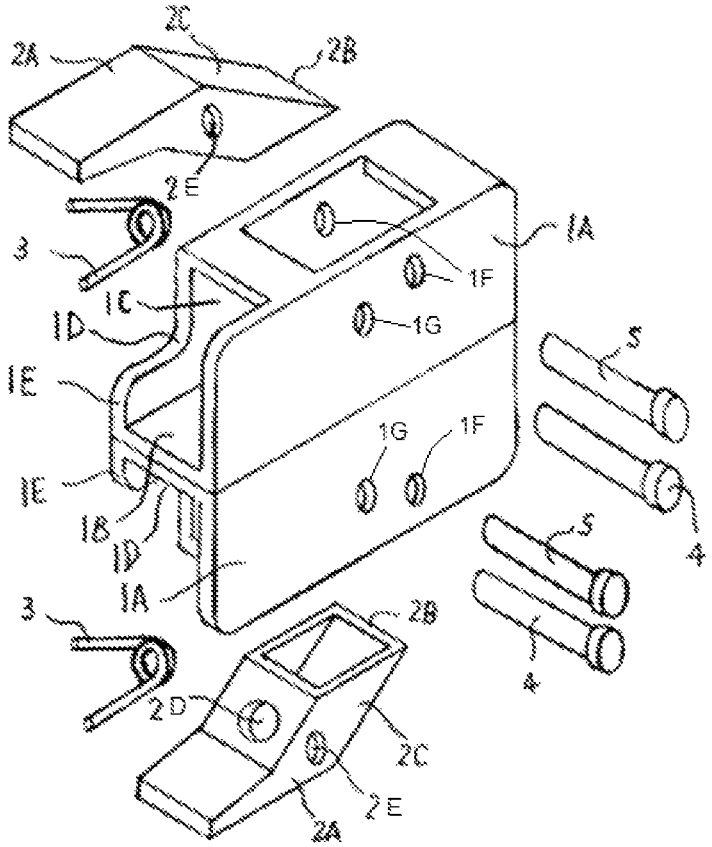
FIG. 7 shows a blow up 3D isometric drawing the parts of an embodiment of a disassembled pair of rear spring support LRDs which can be attached to one another in a parallel configuration as a "Ratchet Buckle". The parts' orientations correspond to their actual orientations in the assembled LRDs.

FIG. 7 shows a blow up 3D isometric drawing of the parts of an embodiment of a disassembled pair of rear spring support LRDs which can be attached to one another in a parallel configuration. The parts' orientations correspond to their actual orientations in the assembled LRD. Pins 5, which are riveted to the LRD housing 1A at holes 1F serve as axles for the turning Gates 2C. The turning gates 2C are shown with their tapered i.e. sharp front ends 2B and their levers 2A. Holes 2E which serve as turning gates' 2C bearings for axles 5 is not denoted in FIGS. 5 and 6 to avoid overcrowding. Openings 2D which serve as passages for the springs' 3 first wire ends in the rotating gates, are shown in FIGS. 5, 6, 7. Rear support for the spring 3 is provided by rear pins 4 which are riveted to the LRD housings 1A through holes 1G.

Figure 8:
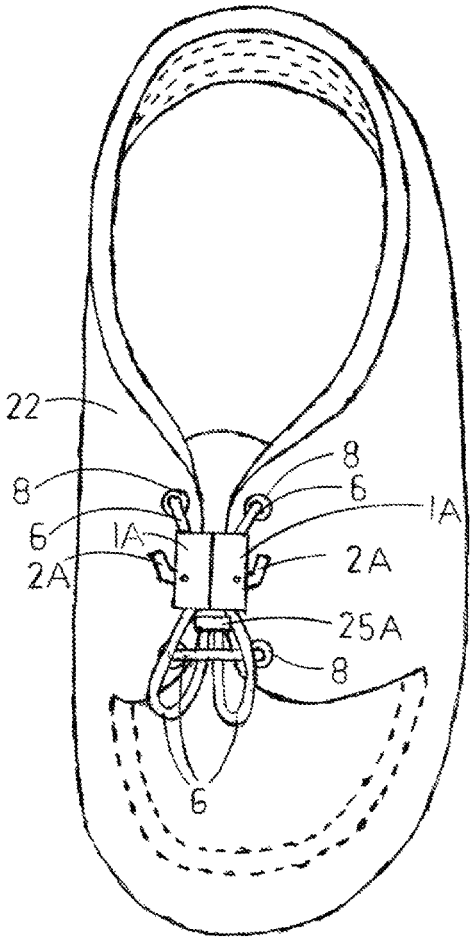
FIG. 8 illustrates a parallel configuration of two rear spring support embodiments of two LRDs, which are used to fasten two ends of one shoe lace serving as a shoe ratchet buckle.

FIG. 8 illustrates how a parallel configuration of two LRDs 1A can be used to fasten two shoe laces serving as a shoe ratchet buckle. Laces 6 which exit from eyelets 8 of the shoe's top 22, enter the parallel configuration of two LRDs 1A and can be fastened simply by pulling forwards at the laces' ends. The fastened laces 6 can be released by pressing simultaneously on opposite levers 2A. The clasp 25A which clasps together the two lace ends is tucked under the lace in order to prevent lace dangling.

Figure 9:
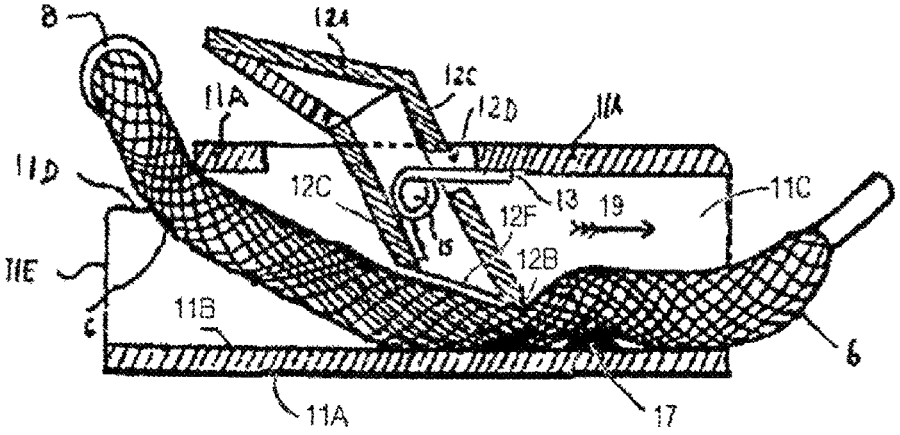
FIGS. 9 and 10 illustrate projections of cross sections of a front spring support embodiment of a LRD with its ratcheting mechanism in active and inactive states respectively.
Figure 10:
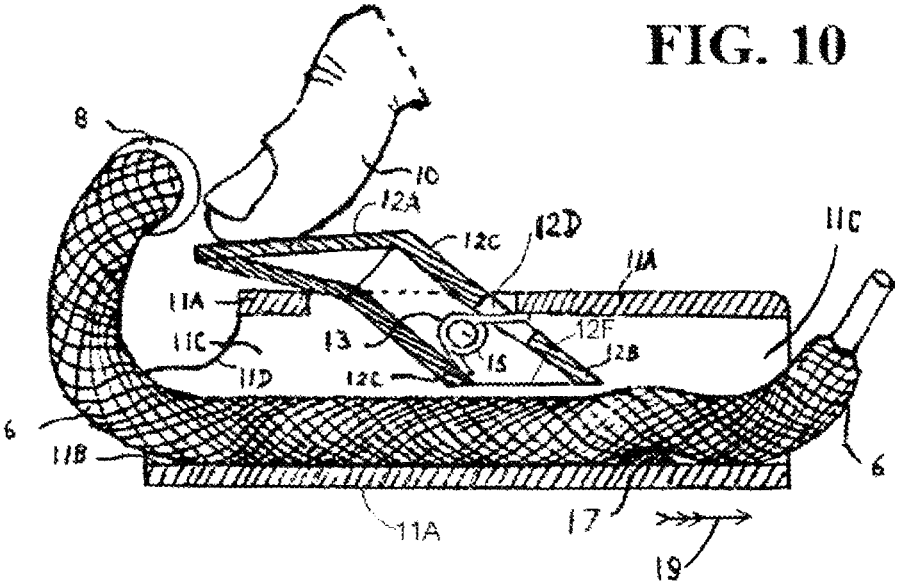

FIGS. 9 and 10 illustrate projections of cross sections of an embodiment of a front spring support LRD with ratcheting mechanisms in active and inactive states respectively. The LRD's housing 11A provides the walls for the channel 11C which houses the turning Gate 12C which is mounted on an axle 15. The channel 11C also houses the lace 6. The turning Gate 12C in FIG. 9 which is in an active state squeezes the lace 6 in the Gap between the Gate's tapered i.e. sharp front end 12B and the channel's gripping wall 11B. In FIG. 10 the turning Gate 12C is in inactive state because the Gate 12C is rotated in counterclockwise direction (also called turning forwards direction) and the Gap between the Gate's tapered i.e. sharp edge at the front end 12B and its gripping wall 11B is wider than the width of lace 6. As shown in FIG. 10, the user has been switching the ratcheting mechanism into an inactive state. This is being done by rotating forwards the turning Gate 12C into an inactive state by pressing downwards on the lever 12A with the user's finger 10. As can be observed in FIG. 9, the turning Gate 12C is in a forward leaning diagonal orientation. In this orientation pulling the lace 6 in forwards direction (to the right) which is denoted by the arrow 19, causes the Gate's front end 12B to move in a combined forwards and laterally inwards motion (i.e. moving upwards and away from the gripping wall 11B) motion. The lateral inwards movement increases the width of the Gap and also turns the tapered i.e. sharp front end 12B away from the lace 6, thus allowing the lace to move forwards more easily with less friction and wear because the lace 6 slides on the gate's smooth side 12F and on the smoothed gripping wall 12B. On the other hand, pulling the lace 6 in backwards direction (to the left) which is opposite to the arrow 19, causes the turning Gate's front end 12B to move in a combined backwards and laterally outwards motion (i.e. moving towards the gripping wall 11B). The laterally outwards movement reduces the width of the Gap, thus squeezing the lace even harder therefore preventing the lace to move further backwards. The bulge 17 which is installed on the gripping wall 11B, increases the b force of the turning Gate 12C even further by forcing the lace to bend when the tapered i.e. sharp front end 12B squeezes it. Both the gripping wall 11B and the bulge 17 have smooth surfaces to minimize the wear of the lace passing in the gap.

The spring 13 which is mounted on the axle 15 is preloaded and has a bias which constantly pushes the turning Gate 11C to turn backwards (i.e. in clockwise direction in FIG. 9). Thus, the spring 13 keeps the LRD in an active state when the user is not pressing on the lever 12A. To switch the Gate's ratcheting mechanism into an inactive state, the user 10 has to press the Gate's lever 12A downwards overcoming the spring's 13 bias. In FIG. 9 the lace 6 exits the shoe's eyelet 8 and enters the channel 11C. The lace 6 in FIG. 9 is fastened and enters the channel 11C via the recess 110. The downwards pressure of the fastened lace 6 on the recess 110 in the lower side wall and the upwards counter pressure of the shoe on the channel's rear segment 11E of the lower side wall create a moment of force which forces the LRD to rotate downwards, thus keeping the LRD flat on the shoe.

Figure 11:
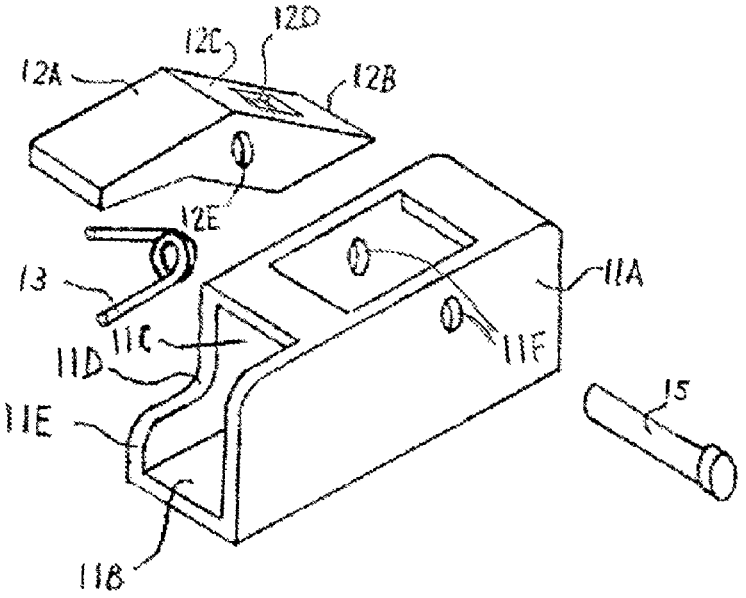
FIG. 11 shows a blow up 3D isometric drawing the parts of a front spring support embodiment of a disassembled LRD. The parts' orientations correspond to their actual orientations in the assembled LRD.

FIG. 11 shows a blow up 3D isometric drawing of the parts of an embodiment of a disassembled front support LRD. The parts' orientations correspond to their actual orientations in the assembled LRD. Pin 15 serves as an axle to the Gate 12C is riveted to holes 11F in the LRD cannel's housing 11A. The turning gate 12C is shown with its tapered i.e. sharp front end 12B and its lever 12A. Hole 12E which serve as a bearing for axle 15 is illustrated in FIG. 11 but is not explicitly denoted in FIGS. 9 and 10 to prevent overcrowding. Opening 12D which serves as a passage for the helical torsion spring's 13 first wire end in the rotating gate, is shown in FIGS. 9, 10, 11.

Figure 12:
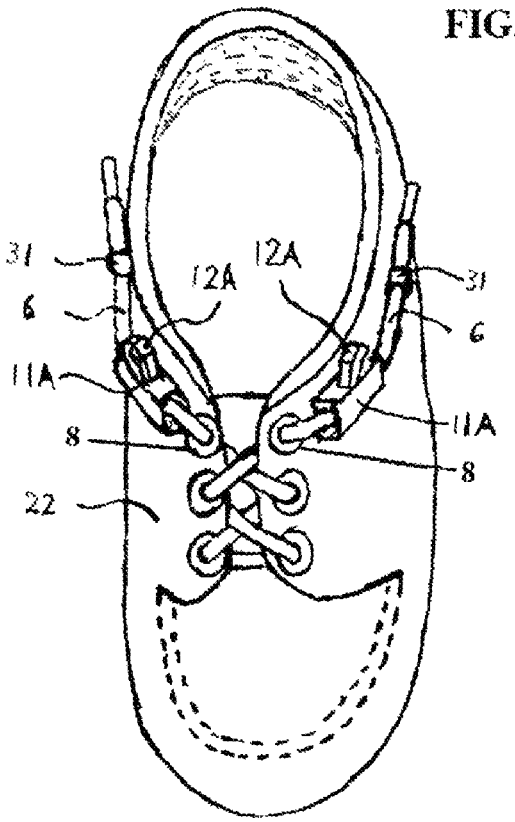
FIG. 12 describes two front spring support embodiments of the LRD, which are installed on two sides of a shoe for lace fastening arrangement.

FIG. 12 describes two LRDs 11A which are installed on a shoe's top 22. The laces 6 which exit the eyelets 8, enter the LRDs 11A and are fastened backwards. The hooks 31 serve as lace end holders to prevent lace dangling.

Figure 13:
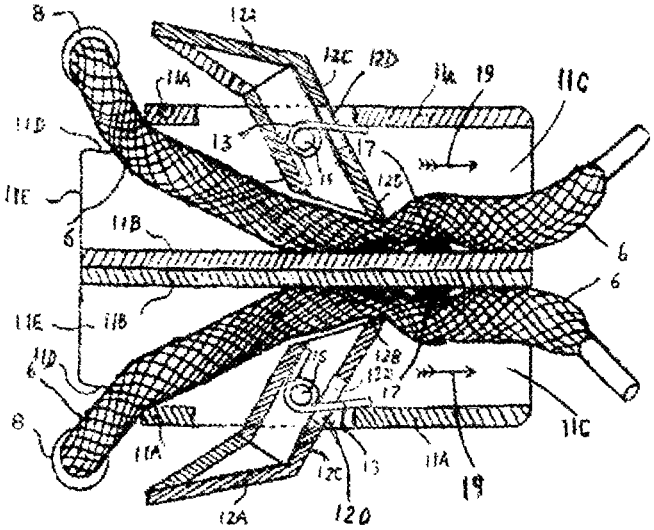
FIG. 13 shows a cross section projection drawing of a pair of front spring support LRDs which are attached to one another in a parallel configuration as a "Ratchet Buckle". The ratcheting mechanisms of the LRDs in FIG. 13 are in active state.
Figure 14:
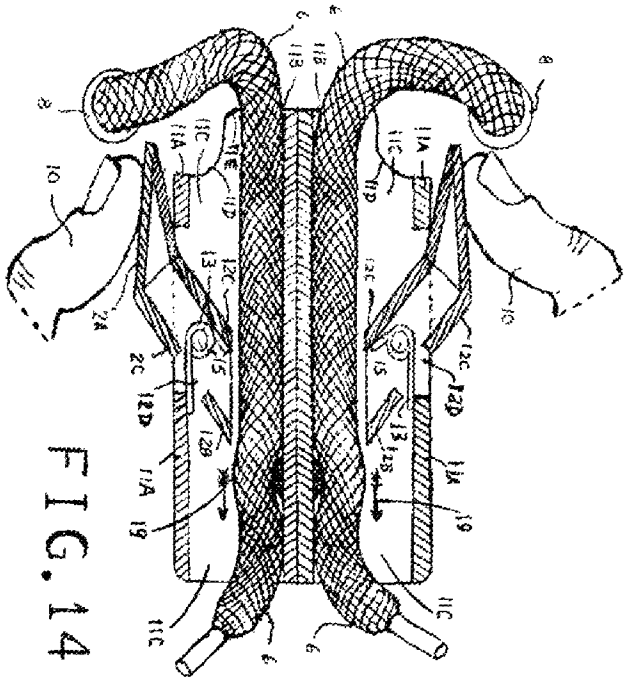
FIG. 14 shows a cross section projection drawing of a pair of front spring support LRDs which are attached to one another in a parallel configuration as a "Ratchet Buckle". The ratcheting mechanisms of the LRDs in FIG. 14 are in inactive state.

FIG. 13 depicts a cross section drawing of a pair of front spring support LRDs which are attached to one another in a parallel configuration. The ratcheting mechanisms of these LRDs are in active states and the laces 6 are fastened. The LRDs' housing 11A provides the walls for the channels 11C which house the turning Gates 12C that are mounted on axles 15. Each of the channels 11C also house a lace 6. The turning Gates 12C in FIG. 13 which are in active states squeeze the laces 6 in the Gaps between the turning Gates' tapered i.e. sharp front ends 12B and the channels' gripping walls 11B. In FIG. 14 the turning Gates 12C are in inactive states because the turning Gates 12C are rotated in forwards direction and the Gap between the Gates' tapered i.e. sharp edges at their front ends 12B and their gripping walls 11B is wider than the widths of laces 6. As shown in FIG. 14, the user has been switching the ratcheting mechanism into inactive states. This is being done by rotating forwards the turning Gates 12C into inactive states by pressing on the levers 12A (which protrude from the top LRD walls) with two of the users' fingers 10. As can be observed in FIG. 13, the turning Gates 12C are in a forward leaning diagonal orientations. In these orientations pulling the laces 6 in forwards direction (to the right) which is denoted by the arrows 19, causes the Gates' front end to move in a combined forwards and laterally inwards motion (i.e. moving away from their gripping walls 11B). The lateral inwards movements increase the widths of the Gaps and also turns the tapered i.e. sharp front ends 12B away from the laces 6, thus allowing the laces to move forwards more easily with less friction and the laces slide on the smooth sides 12F of the front ends 12B and on the smoothed gripping walls 11B with minimal wear. On the other hand, pulling the laces 6 in backwards directions (to the left) which is opposite to the arrows 19, causes the turning Gates' front ends to move in a combined backwards and laterally outwards motions (i.e. moving towards the gripping walls 11B). The laterally outwards movements reduce the widths of the Gaps, thus squeezing the laces even harder therefore preventing the laces to move further backwards. The bulges 17 which are installed on the gripping walls 11B, increase the b force of the turning Gates 12C even further by forcing the laces to bend when the front ends 12B squeezes them. Both the gripping walls 11B and the bulges 17 have smooth surfaces to minimize the wear of the lace passing in the gap.

In FIGS. 13 and 14 the springs 13 which are mounted on the axles 15 are preloaded and have a bias which constantly pushes the turning Gates 11C to turn backwards. Thus, the springs 13 keep the LRDs in a active state when the user is not pressing on the gate levers 12A. To switch the Gates' ratcheting mechanisms into inactive states, the user 10 has to press the levers 12A overcoming the springs' 13 biases—as shown in FIG. 14. In FIG. 13 the laces 6 exit the shoe's eyelets 8 and enter the channels 11C. The laces 6 in FIG. 13 are fastened and enter the channels 11C via the recesses 110 in the lower side walls which are situated at the lower side walls of the entrances of the channels 11C. The downwards pressure of the fastened laces 6 on the recesses 110 create as a reaction an equal counter upwards pressure of the shoe on the channels' entrance rear segments 11E. The downwards pressure coupled with the upwards pressure generate a rotating moment force which tends to press the bottom part of the LRDs parallel configuration against the top part of the shoe. Whereby, keeping the LRDs parallel configuration pressed flat on top of the shoe.

Figure 15:
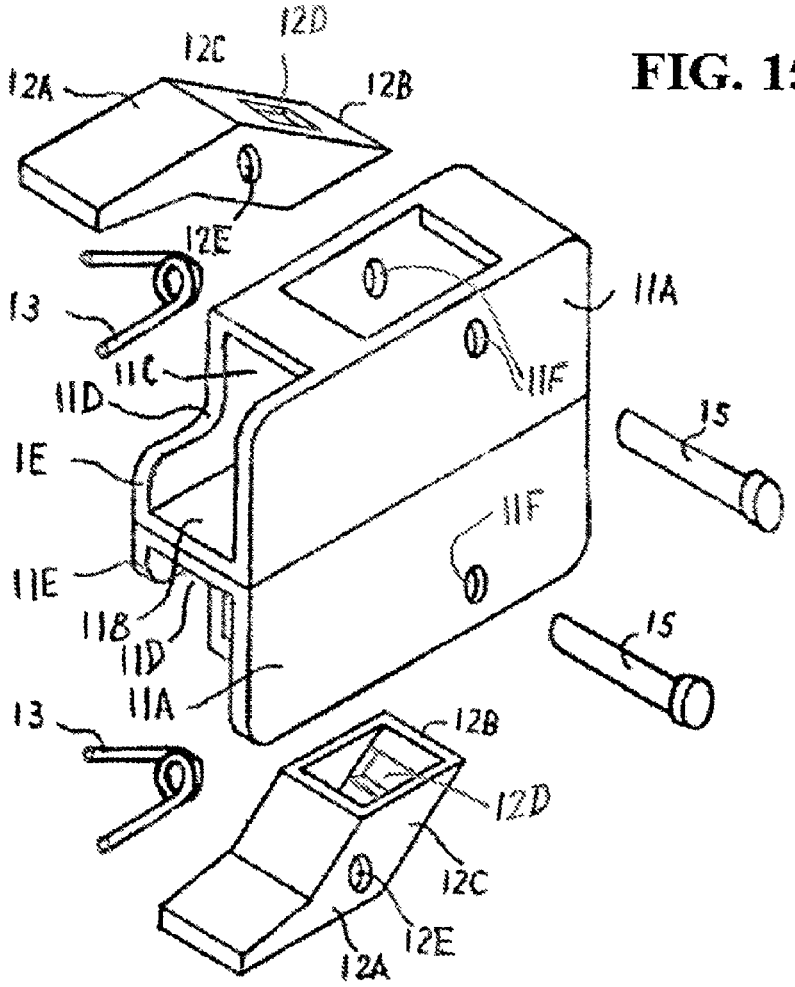
FIG. 15 shows a blow up 3D isometric drawing the parts of an embodiment of a disassembled pair of front spring support LRDs which can be attached to one another in a parallel configuration as a "Ratchet Buckle". The parts' orientations correspond to their actual orientations in the assembled LRDs.

FIG. 15 shows a blow up 3D isometric drawing of the parts of an embodiment of a disassembled pair of front spring support LRDs which can be attached to one another in a parallel configuration. The parts' orientations correspond to their actual orientations in the assembled LRD. Pins 15 serve as axles to the turning Gates 12C. The turning gates 12C are shown with their tapered i.e. sharp front ends 12B and their levers 12A. Holes 12E which serve as a bearings for axles 15 are illustrated in FIG. 15 but are not explicitly denoted in FIGS. 13 and 14 to avoid overcrowding. The pins 15 are riveted into holes 11F in the LRD housings 11A. Openings 12D which serve as passages for the springs' 13 first wire ends in the rotating gates for front spring support, are shown in FIGS. 13, 14, 15.

Figure 16:
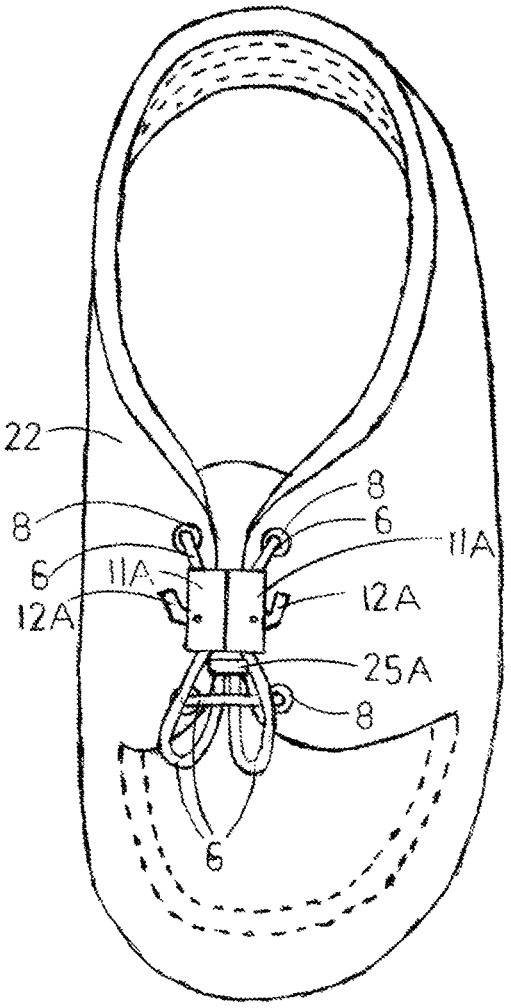
FIG. 16 illustrates a parallel configuration of two front spring support embodiments of two LRDs which are used to fasten two ends of a single shoe lace serving as a shoe ratchet buckle.

FIG. 16 illustrates how a parallel configuration of two LRDs 11A can be used to fasten two shoe laces serving as a shoe ratchet buckle. Laces 6 which exit from eyelets 8 of the shoe's top 22, enter the parallel configuration of two LRDs 11A and can be fastened simply by pulling forwards at the laces' 6 ends. The fastened laces 6 can be released by pressing simultaneously on opposite protruding levers 12A. The clasp 25A which clasps together the two lace ends is tucked under the lace in order to prevent lace dangling.

Figure 17:
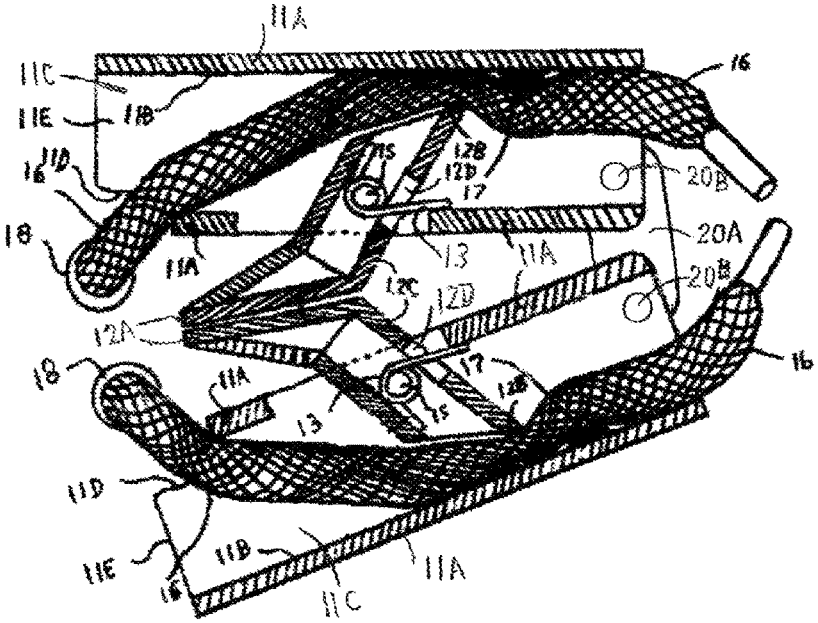
FIG. 17 shows a cross section projection drawing of a pair of front spring support LRDs which are attached to one another in a triangular configuration as a "Ratchet Buckle". The ratcheting mechanisms of the LRDs in FIG. 17 are in active state.
Figure 18:
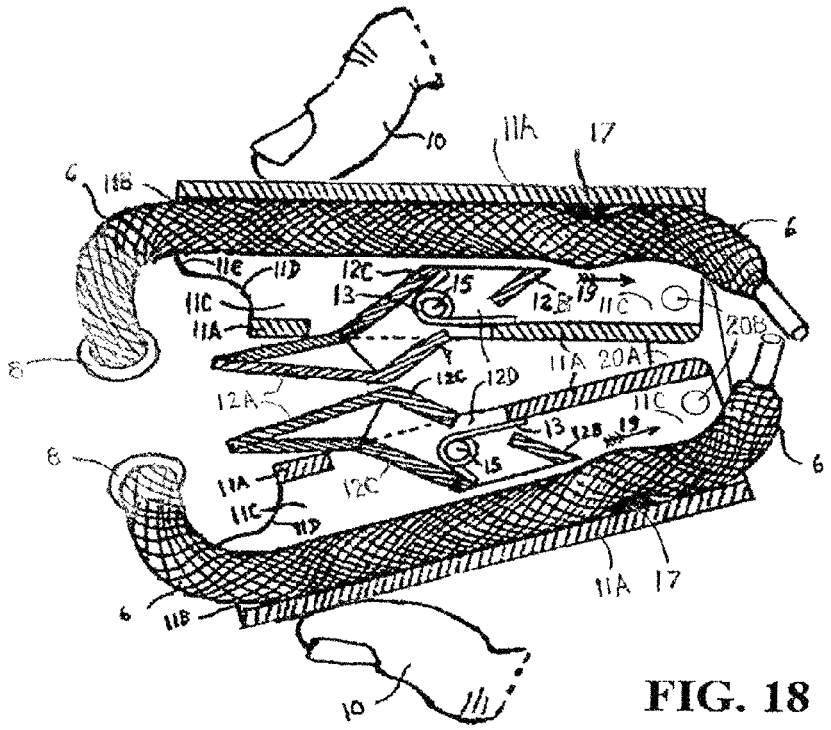
FIG. 18 shows a cross section projection drawing of a pair of front spring support LRDs which are attached to one another in a triangular configuration as a "Ratchet Buckle". The ratcheting mechanisms of the LRDs in FIG. 18 are in inactive state.

To eliminate the protruding gate levers, two LRDs can be installed in a triangular configuration. The triangular configuration of front spring support LRDs is illustrated in FIGS. 17-20. The two channel's gripping walls 11B form the two sides of a narrow triangle while the two levers 12A are facing one another between the channels at the triangle's center. The two channels' 11C housings 11A are hinged by two hinges 20B to a connecting plate 20A and can turn one with respect to the other. A cross section drawing of the triangular configuration LRD in active state is presented in FIG. 17. The triangular configuration LRDs in FIGS. 17-20 have springs 13 with front supports, i.e. the first wire ends of the helical torsion springs 13 are supported by the top walls. In the active state the triangular configuration LRDs have a triangle base which is wider than the base in inactive state since the two gate levers 12A, which are facing one another are protruding more from the channels 11C because the LRDs are in active state. The gate levers 12A in FIG. 18 are compressed, which is described by a cross section of the triangular configuration LRD in inactive state. The user (as shown in FIG. 18) can inactivate both LRDs easily by pressing on both sides of the triangular configuration i.e. on the channels' gripping walls 11B with two fingers 10 of one hand. The pressure causes the channels 11C to rotate one towards the other on hinges 20B and at the same time to press the gate levers 12A which are facing one another. When the gate levers 12A are pressed the turning gates 12C turn forwards on their axles 15 and cause their tapered i.e. sharp edges at their front ends 12B to move laterally inwards (i.e. away from their gripping walls 11B) in their respective channels. The front ends 12B motion increases the gaps between the gates' front ends 12B and their gripping walls 11B, which inactivates the ratcheting mechanisms of the LRDs and allows the laces 6 to move freely in their respective channels.

Figure 19:
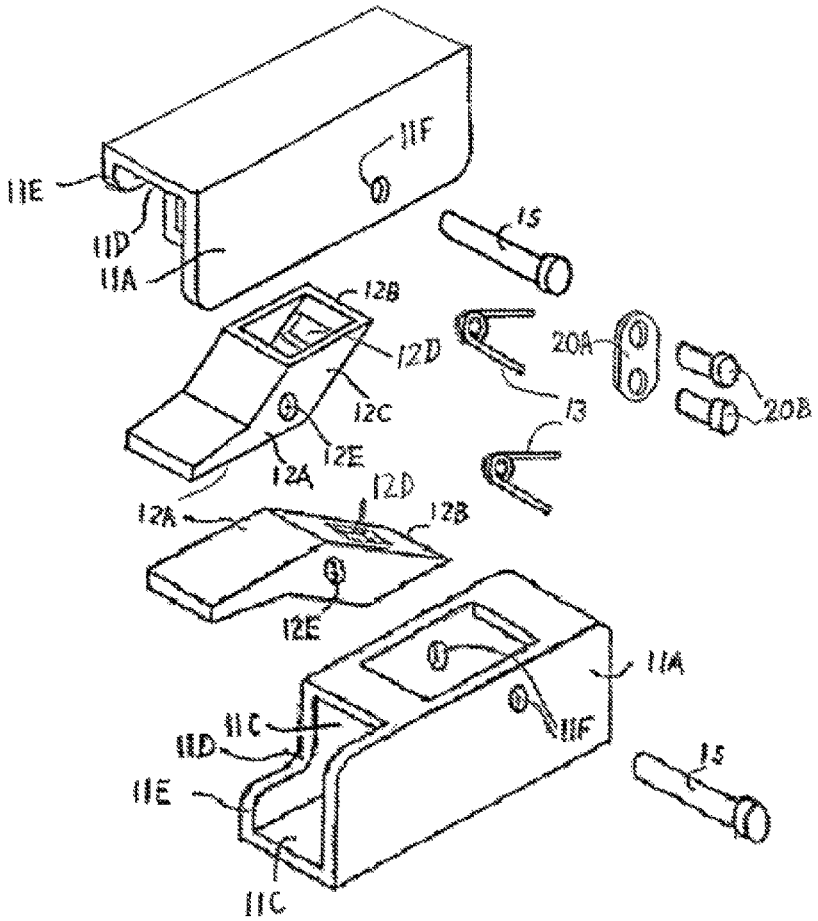
FIG. 19 shows a blow up 3D isometric drawing the parts of an embodiment of a disassembled pair of front spring support LRDs which can be attached to one another in a triangular configuration as a "Ratchet Buckle". The parts' orientations correspond to their actual orientations in the assembled LRDs.

FIG. 19 illustrates a blow up 3D isometric drawing of the parts of an embodiment of a disassembled pair of front spring support LRDs which can be attached to one another in a triangular configuration. The parts' orientations correspond to their actual orientations in the assembled LRD. Pins 15 serve as axles to the turning Gates 12C. The turning gates 12C are shown with their tapered i.e. sharp front ends 12B and their levers 12A. Holes 12E which serve as a bearings for axles 15 are illustrated in FIG. 19 but are not denoted explicitly in FIGS. 17 and 18 to avoid overcrowding. The pins 15 which serve as axles are riveted into holes 11F in the LRD housings 11A. Openings 12D which serve as passages for front spring supports for the springs' 13 first wire ends in the rotating gates 12C, are shown in FIGS. 17, 8, 19. The two channels' housings 11A are hinged to one another by the two hinges 20B which are riveted to the connecting plate 20A.

The triangular configuration has the advantage that it has better outlined shape since it does not have protruding gate levers on both sides. Both the structures of the parallel configuration and triangular configuration of two LRDs are designed to lie flat on top of the shoe when the laces are fastened. This is achieved by entering the laces via recesses 110 in the lower side walls of the LRD channels. The downwards pressure of the laces when fastened on the recesses 110 and the equal upwards pressure which is generated as an equal reaction to the downwards pressure, is applied on the channels rear segments 11E, and create a rotation moment force which forces the lower side wall of the LRDs to lie flat on the top side of the shoe.

Figure 20:
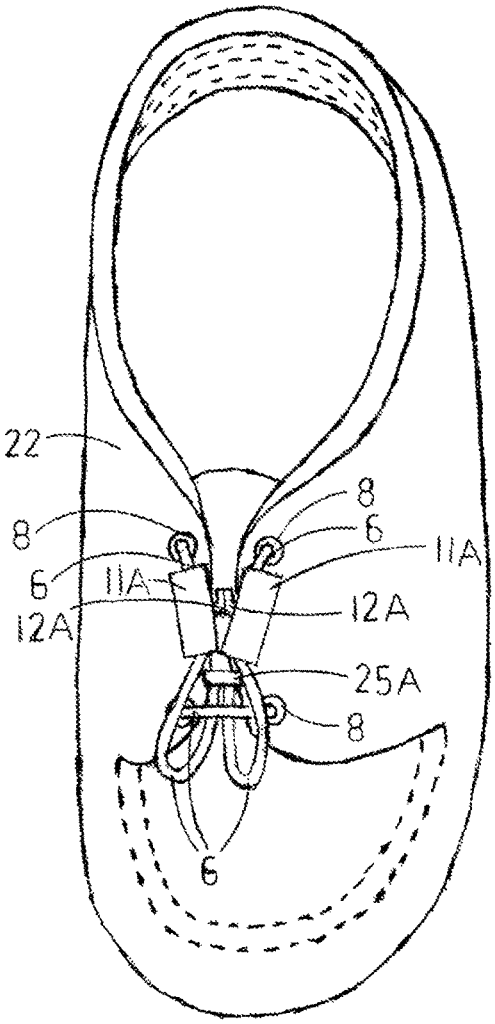
FIG. 20 illustrates a triangular configuration of two front spring support embodiments of LRDs, which are used to fasten two ends of a single shoe lace serving as a shoe ratchet buckle.

FIG. 20 illustrates how a triangular configuration of two front spring support LRDs 11A can be used to fasten two shoe laces serving as a shoe ratchet buckle. Laces 6 which exit from eyelets 8 of the shoe's top 22, enter the triangular configuration of two LRDs 11A and can be fastened simply by pulling forwards at the laces' ends. The fastened laces 6 can be released by pressing simultaneously on opposite channel sides 11A. The clasp 25A which clasps together the two lace ends is tucked under the lace in order to prevent lace dangling.

Figure 21:
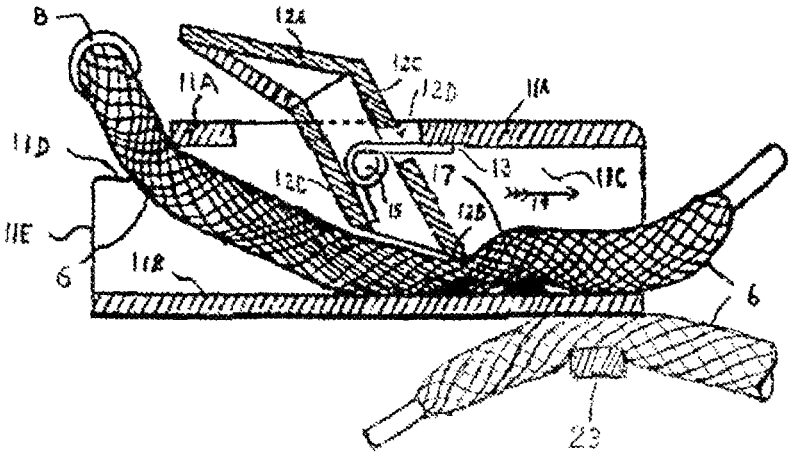
FIGS. 21 and 22 illustrate projections of cross sections of a front spring support embodiments of a LRD for a single lace fastening with their ratcheting mechanisms in active and inactive states respectively. Such LRDs could be used to fasten laces in clothing articles, etc.
Figure 22:
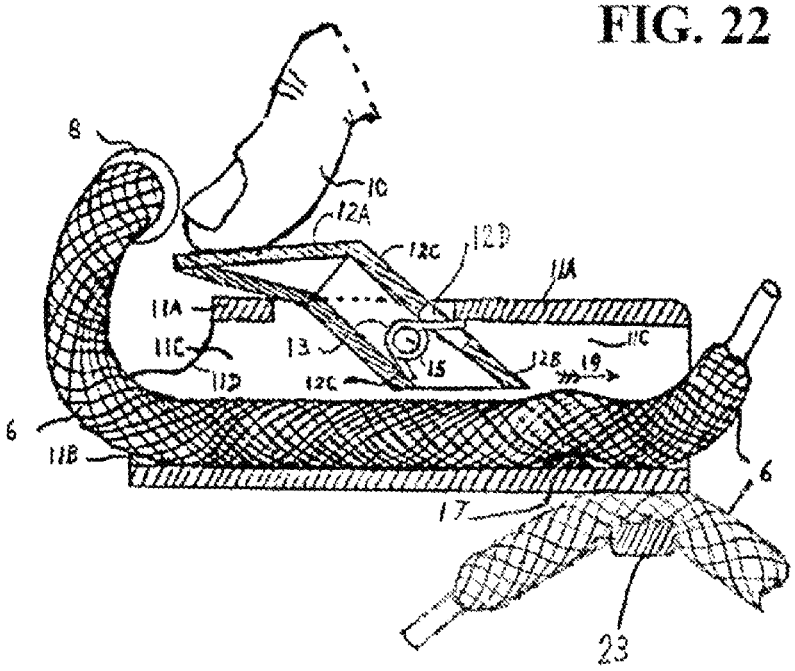

FIGS. 21 and 22 depict a single front spring support LRD which can be used to fasten laces of trousers, coats or other objects simply by tying one lace end to the LRD and using the LRD to fasten the other lace's end. Such a LRD is illustrated in FIGS. 21 and 22 by cross sections of an embodiment of a front spring support LRD with ratcheting mechanisms in active and inactive states respectively. The LRD's housing 11A provides the walls for the channel 11C which houses the turning Gate 12C which is mounted on an axle 15. The channel 11C also houses the lace 6. The turning Gate 12C in FIG. 21 which is in an active state squeezes the lace 6 in the Gap between the Gate's front end 12B and the channel's gripping wall 11B. In FIG. 22 the turning Gate 12C is in inactive state because the Gate 12C is rotated in counterclockwise direction (also called forwards direction) and the Gap between the Gate's tapered i.e. sharp front end 12B and its gripping wall 11B is wider than the width of lace 6. As shown in FIG. 22, the user has been switching the ratcheting mechanism into an inactive state. This is being done by rotating forwards the turning Gate 12C into an inactive state by pressing downwards on the lever 12A with the user's finger 10.

As can be observed in FIG. 21, the turning Gate 12C is in a forward leaning diagonal orientation. In this orientation pulling the lace 6 in forwards direction (to the right) which is denoted by the arrow 19, drags the Gate's front end 12B due to front end—lace mutual friction and forces it to move in a combined forwards and laterally inwards motion (i.e. moving upwards and away from the gripping wall 11B) motion. The lateral inwards movement increases the width of the Gap and also turns the tapered i.e. sharp front end 12B away from the lace 6, thus allowing the lace to move forwards more easily with less friction and wear. On the other hand, pulling the lace 6 in backwards direction (to the left) which is opposite to the arrow 19, drags the turning Gate's front end 12B and forces it to move in a combined backwards and laterally outwards motion (i.e. moving towards the gripping wall 11B). The laterally outwards movement reduces the width of the Gap, thus squeezing the lace even harder therefore restricting the lace to movement further backwards. The bulge 17 which is installed on the gripping wall 11B, increases the blocking force of the turning Gate 12C even further by forcing the lace to bend when the front end 12B squeezes it. Both the gripping wall 11B and the bulge 17 have smooth surfaces to minimize the wear of the lace passing in the gap.

The helical torsion spring 13 which is mounted on the axle 15 is preloaded and has a bias which constantly pushes the turning Gate 11C to turn backwards (i.e. in clockwise direction in FIG. 21). Thus, the spring 13 keeps the LRD in an active state when the user is not pressing on the lever 12A. To switch the Gate's ratcheting mechanism into an inactive state, the user 10 has to press the Gate's lever 12A downwards overcoming the spring's 13 bias. In FIG. 21 the lace 6 exits the garment's eyelet 8 and enters the channel 11C. The lace 6 in FIG. 21 is fastened and enters the channel 11C via the recess 110 in the lower side wall. The downwards pressure of the fastened lace 6 on the recess 110 and the upwards counter pressure of the garment on the lower side wall's rear segment 11E create a moment force which forces the LRD to rotate downwards, i.e. towards the garment thus keeping the LRD flat on the garment. The garment LRD is tied to the second end of the lace 6 by the pressing ring 23. Thus, fastening force of the lace 6 end on the LRD towards the left is countered by the force towards the right exerted by the other lace's end, which is attached to the LRD by the ring 23.

Figure 23:
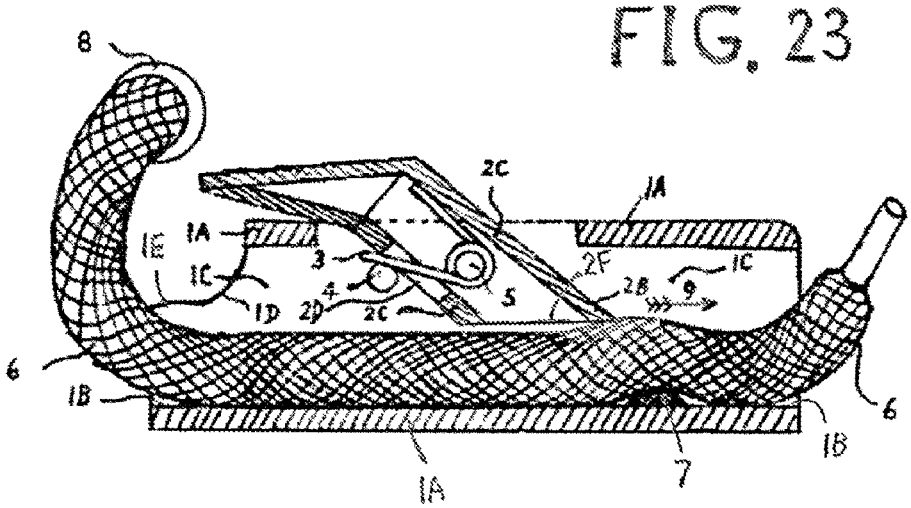
FIGS. 23 and 24 depict the lace sliding operation on the smooth sides of the front ends of turning gates of the LRDs while fastened.
Figure 24:
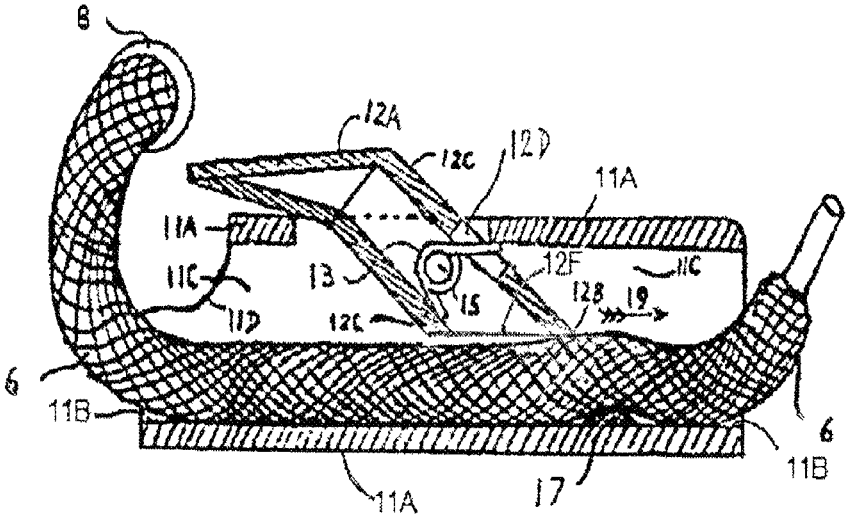

FIGS. 23 and 24 depict the lace sliding operation on the smooth sides of the front ends of gates of rear and front spring support LRDs respectively, while fastened. FIGS. 23 and 24 show the sliding on the smooth sides of the front ends of gates of LRDs with rear and front spring support respectively. Referring to FIG. 23, when lace 6 is fastened it drags the front end 2B of the turning gate 2C forwards (i.e. towards the right—arrow 9). This turns the gate 2C forwards and the lace which was squeezed in the gap by the tapered i.e. sharp end of the front end 2B is now in touch with the tapered i.e. sharp edge's smooth side 2F. This enables it to slide on the smooth side 2F with minimal wear. The other side of the lace 6 is touching the smooth surface of the gripping wall 1B which also does not wear the lace 6.

Referring to FIG. 24, (which depicts front spring support LRD) when lace 6 is fastened it drags the front end 12B of the turning gate 12C forwards (i.e. towards the right arrow 19). This turns the gate 12C forwards and the lace which was squeezed in the gap by the tapered i.e. sharp end of the front end 12B is now in touch with the tapered i.e. sharp edge's smooth side 12F. This enables it to slide on the smooth side 12F with minimal wear. The other side of the lace 6 is touching the smooth surface of the gripping wall 11B which also does not wear the lace 6.

Figure 25:
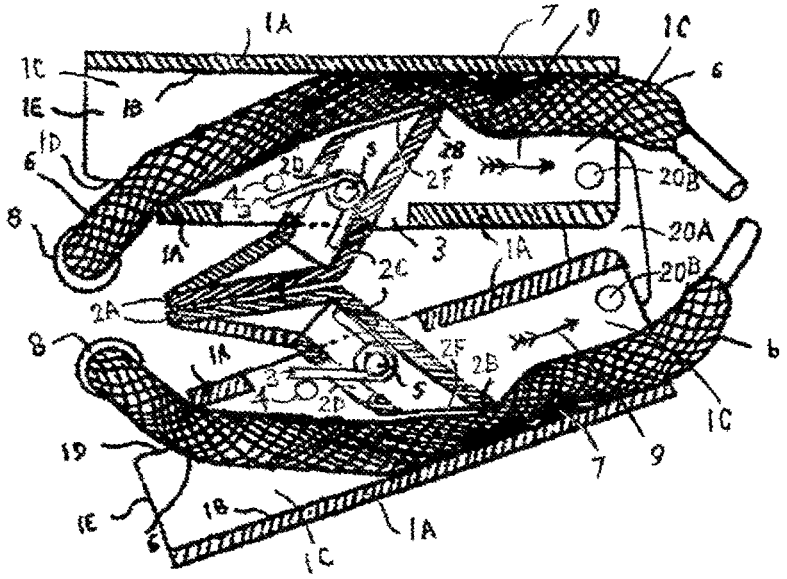
FIG. 25 shows a cross section projection drawing of a pair of rear spring support LRDs which are attached to one another in a triangular configuration as a "Ratchet Buckle". The ratcheting mechanisms of the LRDs in FIG. 25 are in active state.
Figure 26:
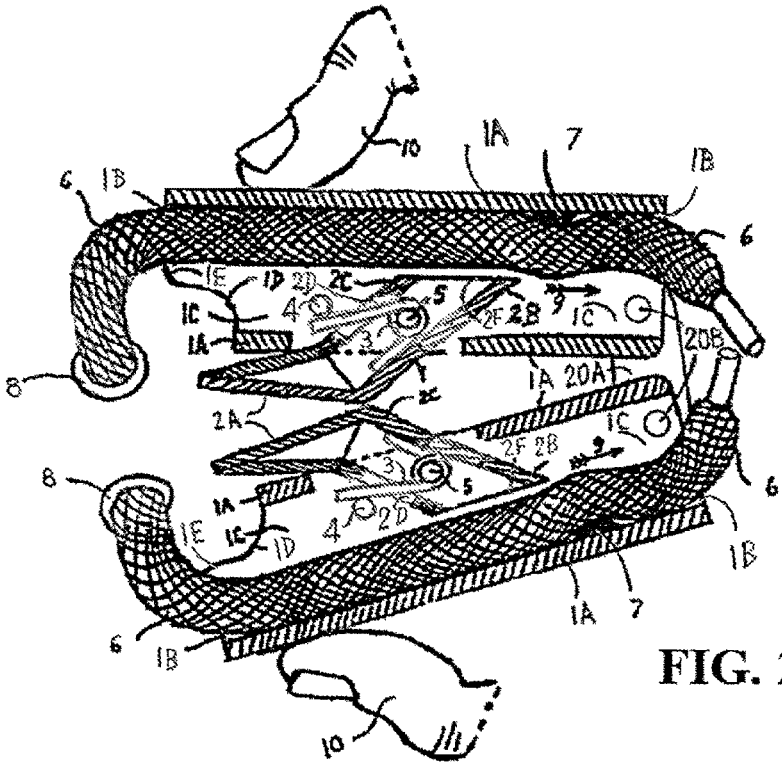
FIG. 26 shows a cross section projection drawing of a pair of rear spring support LRDs which are attached to one another in a triangular configuration as a "Ratchet Buckle". The ratcheting mechanisms of the LRDs in FIG. 26 are in inactive state.
Figure 27:
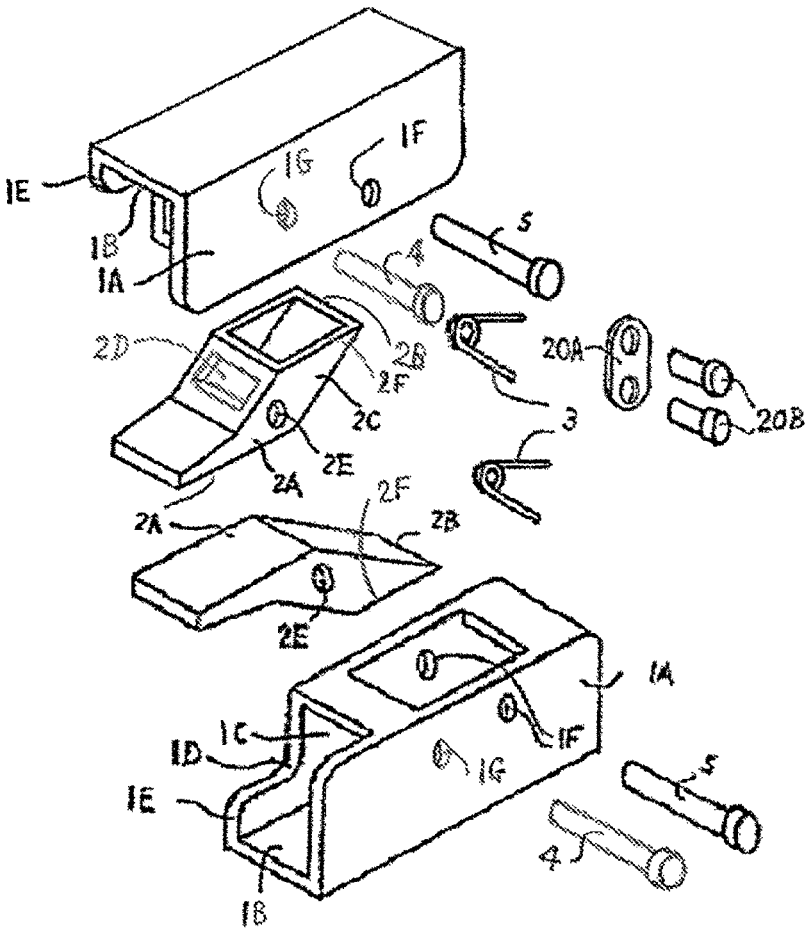
FIG. 27 shows a blow up 3D isometric drawing the parts of an embodiment of a disassembled pair of rear spring support LRDs which can be attached to one another in a triangular configuration as a "Ratchet Buckle". The parts' orientations correspond to their actual orientations in the assembled LRDs.

To eliminate the protruding gate levers, two LRDs can be installed in a triangular configuration. The triangular configuration of rear spring support LRDs is illustrated in FIGS. 25-27. The two channel's gripping walls 1B form the two sides of a narrow triangle while the two levers 2A are facing one another between the channels at the triangle's center. The two channels' 2C housings 2A are hinged by two hinges 20B to a connecting plate 20A and can turn one with respect to the other. A cross section drawing of the triangular configuration LRD in active state is presented in FIG. 25. The triangular configuration LRDs in FIGS. 25-27 have springs 3 with rear supports, i.e. the first wire ends of the helical torsion springs 3 are supported by the rear pins 4. In the active state the triangular configuration LRDs have a triangle base which is wider than the base in inactive state since the two gate levers 2A, which are facing one another are protruding more from the channels 1C because the LRDs are in active state. The gate levers 2A in FIG. 26 are compressed, which is described by a cross section of the triangular configuration LRD in inactive state. The user can inactivate both LRDs easily by pressing on both sides of the triangular configuration i.e. on the channels' gripping walls 1B with two fingers 10 of one hand. The pressure causes the channels 1C to rotate one towards the other and at the same time to press the gate levers 2A which are facing one another. When the gate levers 2A are pressed the turning gates 2C turn forwards on their axles 5 and cause their tapered i.e. sharp edges at their front ends 2B to move laterally inwards (i.e. away from their gripping walls 1B) in their respective channels. The front ends 2B motion increases the gaps between the gates' front ends 2B and their gripping walls 1B, which inactivates the LRDs and allows the laces 6 to move freely in their respective channels.

FIG. 27 illustrates a blow up 3D isometric drawing of the parts of an embodiment of a disassembled pair of rear spring support LRDs which can be attached to one another in a triangular configuration. The parts' orientations correspond to their actual orientations in the assembled LRD. Pins 5 serve as axles to the turning Gates 2C. The turning gates 2C are shown with their tapered i.e. sharp front ends 2B and their levers 2A. Holes 2E which serve as a bearings for axles 5 are illustrated in FIG. 27 but are not denoted explicitly in FIGS. 25 and 26 to avoid overcrowding. The pins 5 are riveted into holes 1F in the LRD housings 1A. Openings 2D which serve as passages for the springs' 3 first wire ends in the rotating gates 2C, are shown in FIGS. 25, 26, 27. The two channels' housings 11A are hinged to one another by the two hinges 20B which are riveted to the connecting plate 20A. Rear pins 4 which provide rear support to the springs 3, are riveted to holes 1G in the channels 1A.

The triangular configuration has the advantage that it has better outlined shape since it does not have protruding gate levers on both sides. Both the structures of the parallel configuration and triangular configuration of two LRDs are designed to lie flat on top of the shoe when the laces are fastened. This is achieved by entering the laces into the channels 1C via recesses 1D in the lower side walls of the LRD channels. The downwards pressure of the laces when fastened on the recesses 1D and the equal upwards pressure which is generated as an equal reaction to the downwards pressure, is applied on the lower side wall's rear segments 1E, and create a rotation moment force which forces the bottom side of the LRDs to lie flat on the top side of the shoe.

Figure 28:
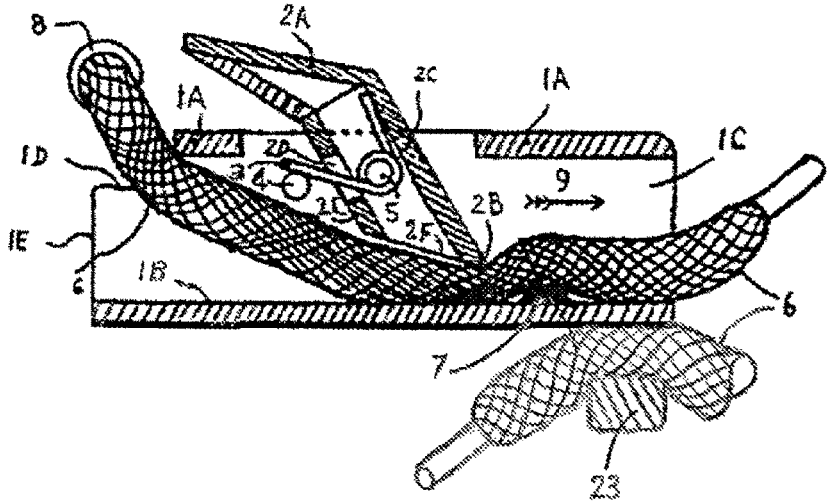
FIGS. 28 and 29 illustrate projections of cross sections of a rear spring support embodiments of a LRD for a single lace fastening with their ratcheting mechanisms in active and inactive states respectively. Such LRDs could be used to fasten laces in clothing articles, etc.
Figure 29:
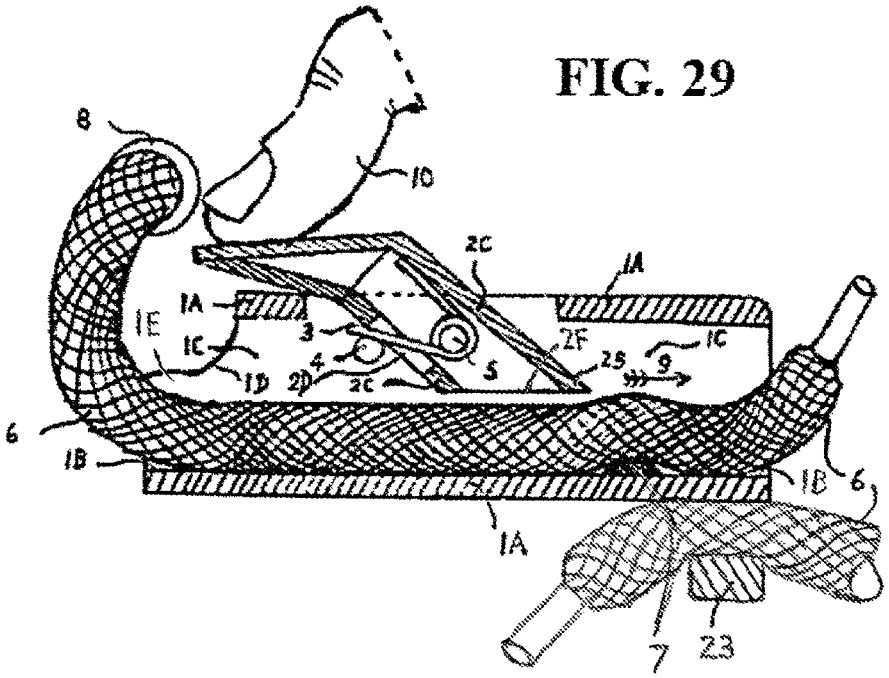

FIGS. 28 and 29 depict a single rear spring support LRD which can be used to fasten laces of trousers, coats or other objects simply by tying one lace end to the LRD and using the LRD to fasten the other lace's end. Such a LRD is illustrated in FIGS. 28 and 29 by cross sections of an embodiment of a rear spring support LRD with ratcheting mechanisms in active and inactive states respectively. The LRD's housing 1A provides the walls for the channel 1C which houses the turning Gate 2C which is mounted on an axle 5. The channel 1C also houses the lace 6. The turning Gate 2C in FIG. 28 which is in an active state squeezes the lace 6 in the Gap between the Gate's front end 2B and the channel's gripping wall 1B. In FIG. 29 the turning Gate 2C is in inactive state because the Gate 2C is rotated in counterclockwise direction (also called forwards direction) and the Gap between the Gate's tapered i.e. sharp front end 2B and its gripping wall 1B is wider than the width of lace 6. As shown in FIG. 29, the user has been switching the ratcheting mechanism into an inactive state. This is being done by rotating forwards the turning Gate 2C into an inactive state by pressing downwards on the lever 2A with the user's finger 10.

As can be observed in FIG. 28, the turning Gate 2C is in a forward leaning diagonal orientation. In this orientation pulling the lace 6 in forwards direction (to the right) which is denoted by the arrow 9, drags the Gate's front end 2B due to front end—lace mutual friction and forces it to move in a combined forwards and laterally inwards motion (i.e. moving upwards and away from the gripping wall 1B) motion. The lateral inwards movement increases the width of the Gap and also turns the tapered i.e. sharp front end 2B away from the lace 6, thus allowing the lace to move forwards more easily with less friction and wear. On the other hand, pulling the lace 6 in backwards direction (to the left) which is opposite to the arrow 9, drags the turning Gate's front end 2B and forces it to move in a combined backwards and laterally outwards motion (i.e. moving towards the gripping wall 1B). The laterally outwards movement reduces the width of the Gap, thus squeezing the lace even harder therefore preventing the lace to move further backwards. The bulge 7 which is installed on the gripping wall 1B, increases the blocking force of the turning Gate 2C even further by forcing the lace to bend when the tapered i.e. sharp front end 2B squeezes it. Both the gripping wall 1B and the bulge 7 have smooth surfaces to minimize the wear of the lace passing in the gap.

The first wire end of the helical torsion spring 3 is supported by the rear pin 4 while the second wire end of the helical torsion spring 3 is supported by the gate 2C wall. The helical torsion spring 3 which is mounted on the axle 15 is preloaded and has a bias which constantly pushes the turning Gate 1C to turn backwards (i.e. in clockwise direction in FIG. 28). Thus, the spring 3 keeps the LRD in an active state when the user is not pressing on the lever 2A. To switch the Gate's ratcheting mechanism into an inactive state, the user 10 has to press the Gate's lever 2A downwards overcoming the spring's 3 bias. In FIG. 28 the lace 6 exits the garment's eyelet 8 and enters the channel 1C. The lace 6 in FIG. 28 is fastened and enters the channel 1C via the recess 1D in the lower side wall. The downwards pressure of the fastened lace 6 on the recess 1D and the upwards counter pressure of the garment on the lower side wall's rear segment 1E create a moment force which forces the LRD to rotate downwards, thus keeping the LRD flat on the garment. The garment LRD is tied to the second end of the lace 6 by the pressing ring 23. Thus, fastening force of the lace 6 end on the LRD towards the left is countered by the force towards the right exerted by the other lace's end, which is attached to the LRD by the ring 23.

Figure 30:
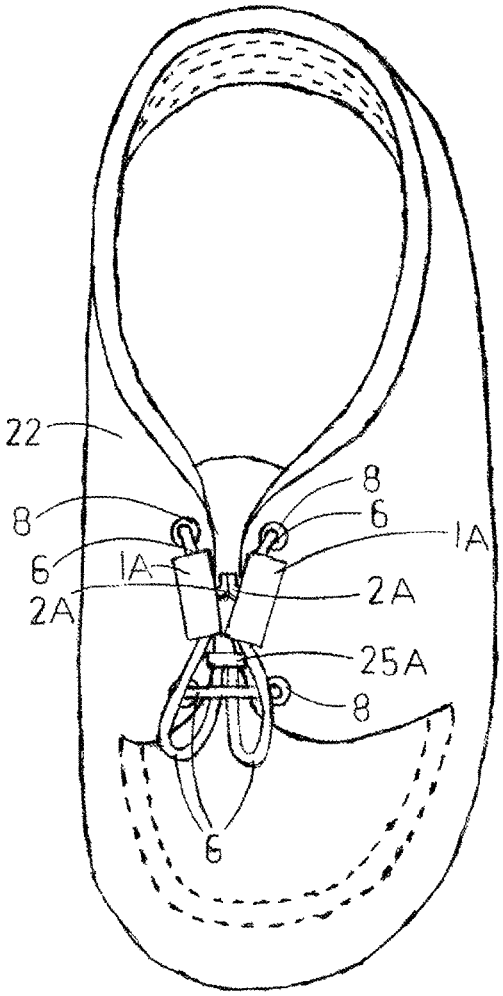
FIG. 30 illustrates a triangular configuration of two rear spring support embodiments of LRDs, which are used to fasten two ends of a single shoe lace serving as a shoe ratchet buckle.

FIG. 30 illustrates how a triangular configuration of two rear spring support LRDs 1A can be used to fasten two shoe laces serving as a shoe ratchet buckle. Laces 6 which exit from eyelets 8 of the shoe's top 22 enter the triangular configuration of two LRDs 1A and can be fastened simply by pulling forwards at the laces' 6 ends. The fastened laces 6 can be released by pressing simultaneously on opposite channel sides 1A. The clasp 25A which clasps together the two lace ends is tucked under the lace in order to prevent lace dangling.

Figure 31:
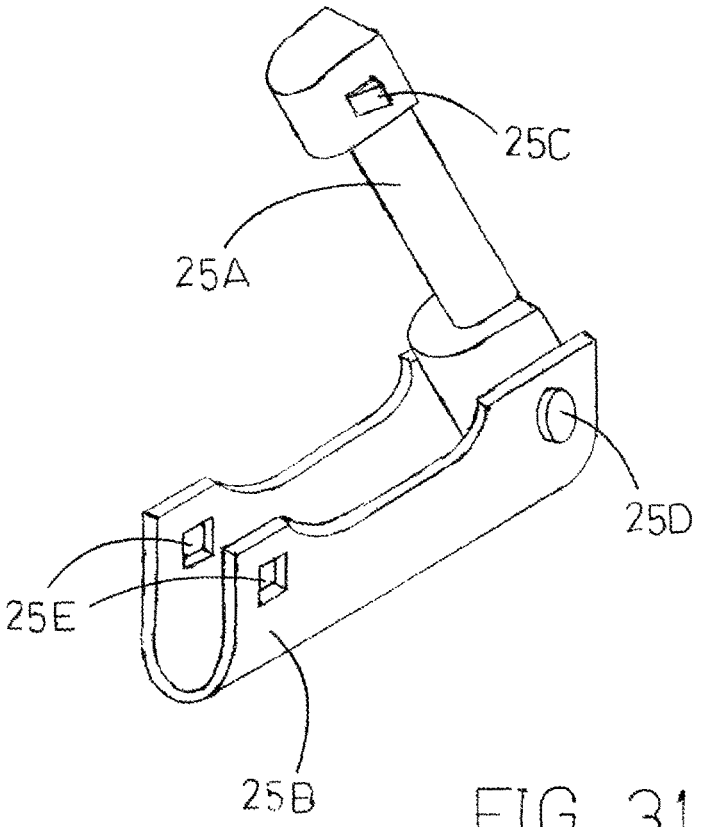
FIG. 31 illustrates a lace clasp for clasping together two laces. The clasp in FIG. 31 is illustrated at unlocked position.

FIG. 31 illustrates a lace clasp for clasping together two laces. The lace clasp in FIG. 31 is illustrated at unlocked position. The arm 25A is rotatably installed on a clasp axle 25D in a clasp housing 25B which is made of an elastic u-shaped channel. The arm 25A which is made of rigid material, has two wedge shaped protrusions 25C, which are configured to fit into two rectangular openings 25E in the clasp housing 25B wall. When the arm 25A is in an upright position, the clasp is in unlocked position. When the arm 25A is rotated into leveled position, the two wedge shaped protrusions 25C are inserted into the two rectangular openings 25E by momentarily widening the elastic u-shaped channel 25B as they move downwards. The wedges 25C hold the arm 25A at a leveled position which is also the locked position. To rotate the arm 25A into unlocked position i.e. upright position, one has to momentarily widen the elastic u-shaped channel and to extract the two wedge shaped protrusions from the rectangular openings 25E. This could be done using a screwdriver.

Figure 32:
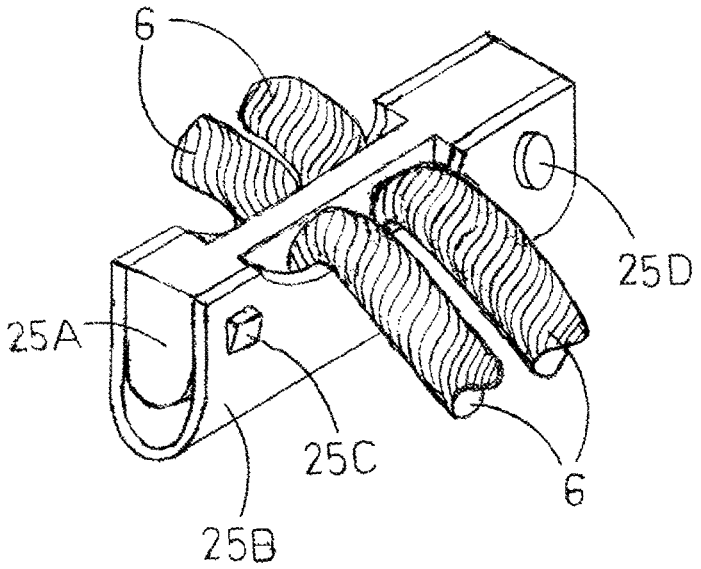
FIG. 32 describes the clasp in a locked position while clasping together two laces.

FIG. 32 describes the clasp in a locked position i.e. when the arm 25A is at leveled position. When the arm 25A is at leveled position, it presses downwards on the two laces 6 and squeezes the laces 6 into the u-shaped channel 25B. Hence, at the locked position the clasp clasping together two laces. As shown in FIGS. 8, 6, 20 and 30, the lace clasp can be anchored by pushing it under the front shoe lace and there it prevents dangling shoe laces.

What is claimed is:

1. A ratcheting device for releasably fastening a lace the ratcheting device comprising:

a lace, and a channel being configured to receive a portion of the lace therethrough;

said channel further includes a gripping wall being adapted with a surface configured to engage said lace;

the ratcheting device has an active state and an inactive state; wherein in said active state the ratcheting device is configured to restrict translation of the lace in the channel in a backwards direction and to facilitate translation of the lace in the channel in a forwards direction;

wherein in said inactive state the ratcheting device is configured to facilitate translation of the lace both in said forwards direction and in said backwards direction;

the ratcheting device further comprising:

a turning gate, and a spring;

the turning gate being rotationally engaged with the channel at a fulcrum, wherein the turning gate comprises a front end and a rear end opposite the front end;

the turning gate is installed at a diagonal orientation with respect to the forwards direction; the front end is disposed diagonally opposite the gripping wall within the channel; wherein the lace is configured to pass through a gap between the front end and the gripping wall; wherein the front end is configured to exert a pressure force on the lace when the turning gate is turned backwards; wherein the front end is pressuring the lace against the surface of the gripping wall;

wherein, the front end is configured to increase the pressure force on the lace when the turning gate is turned increasingly backwards, and the front end is configured to reduce the pressure force on the lace when the turning gate is turned increasingly forwards;

at the active state, the front end is configured to exert said pressure force on the lace and the front end is configured to frictionally engage the lace and to turn forwards the turning gate when the lace is translated in said forwards direction; also, at the active state the front end is configured to frictionally engage the lace and to turn backwards the turning gate when the lace is translated in said backwards direction;

wherein, forwards translation of the lace is facilitated by turning increasingly forwards the turning gate and consequently diminishing the pressure force of the front end on the lace; whereas backwards translation of the lace is restricted by turning increasingly backwards the turning gate and consequently increasing the pressure force of the front end on the lace;

at the inactive state of the ratcheting device, the front end is configured not to exert said pressure force on the lace and the lace translation is facilitated both in the forwards direction and in the backwards direction;

the spring is preloaded and configured to apply a backwards turning force on the turning gate causing the front end to apply said pressure force on the lace;

the rear end is being configured as a lever for manually turning the turning gate forwards and diminishing the pressure force exerted by the front end on the lace; wherein, releasing the lace.

2. The ratcheting device of claim 1, wherein said fulcrum comprises an axle which is fitted in a bearing.

3. The ratcheting device of claim 1, wherein said spring is a torsion spring; the torsion spring has a resilient helical wire structure with a first wire end and a second wire end; wherein said torsion spring is installed preloaded with a bias which applies said backwards turning force on the turning gate.

4. A ratcheting device for releasably fastening a lace, the ratcheting device comprising:

a lace, and a channel being configured to receive a portion of the lace therethrough;

said channel further includes a gripping wall being adapted with a surface configured to engage said lace;

the ratcheting device has an active state and an inactive state; wherein in said active state the ratcheting device is configured to restrict translation of the lace in the channel in a backwards direction and to facilitate translation of the lace in the channel in a forwards direction;

wherein in said inactive state the ratcheting device is configured to facilitate translation of the lace both in said forwards direction and in said backwards direction;

the ratcheting device further comprising:

a turning gate, and a spring;

the turning gate being rotationally engaged with the channel at a fulcrum, wherein the turning gate comprises a front end and a rear end opposite the front end;

the turning gate is installed at a diagonal orientation with respect to the forwards direction; the front end is disposed diagonally opposite the gripping wall within the channel; wherein the lace is configured to pass through a gap between the front end and the gripping wall; wherein the front end is configured to exert a pressure force on the lace when the turning gate is turned backwards; wherein the front end is pressuring the lace against the surface of the gripping wall;

wherein, the front end is configured to increase the pressure force on the lace when the turning gate is turned increasingly backwards, and the front end is configured to reduce the pressure force on the lace when the turning gate is turned increasingly forwards;

at the active state, the front end is configured to exert said pressure force on the lace and the front end is configured to frictionally engage the lace and to turn forwards the turning gate when the lace is translated in said forwards direction; also, at the active state the front end is configured to frictionally engage the lace and to turn backwards the turning gate when the lace is translated in said backwards direction;

wherein, forwards translation of the lace is facilitated by turning increasingly forwards the turning gate and consequently diminishing the pressure force of the front end on the lace; whereas backwards translation of the lace is restricted by turning increasingly backwards the turning gate and consequently increasing the pressure force of the front end on the lace;

at the inactive state of the ratcheting device, the front end is configured not to exert said pressure force on the lace and the lace translation is facilitated both in the forwards direction and in the backwards direction;

the spring is preloaded and configured to apply a backwards turning force on the turning gate causing the front end to apply said pressure force on the lace;

the rear end is being configured as a lever for manually turning the turning gate forwards and diminishing the pressure force exerted by the front end on the lace; wherein, releasing the lace;

wherein said front end comprises a tapered edge and a smooth side;

wherein, the tapered edge is configured to concentrate said pressure force when the turning gate is turned backwards and the front end engages the lace;

wherein, the smooth side is configured to engage the lace when the turning gate is turned forwards; wherein, the smooth side reduces said lace wear when the lace is translated in the forwards direction.

5. The ratcheting device of claim 1, wherein the surface of the gripping wall comprises a smooth surface; wherein, the smooth surface reduces said lace wear when the lace is fastened at said active state and also when said lace is translated in said inactive state.

6. A ratcheting device for releasably fastening a lace, the ratcheting device comprising:

a lace, and a channel being configured to receive a portion of the lace therethrough;

said channel further includes a gripping wall being adapted with a surface configured to engage said lace;

the ratcheting device has an active state and an inactive state; wherein in said active state the ratcheting device is configured to restrict translation of the lace in the channel in a backwards direction and to facilitate translation of the lace in the channel in a forwards direction;

wherein in said inactive state the ratcheting device is configured to facilitate translation of the lace both in said forwards direction and in said backwards direction;

the ratcheting device further comprising:

a turning gate, and a spring;

the turning gate being rotationally engaged with the channel at a fulcrum, wherein the turning gate comprises a front end and a rear end opposite the front end;

the turning gate is installed at a diagonal orientation with respect to the forwards direction; the front end is disposed diagonally opposite the gripping wall within the channel; wherein the lace is configured to pass through a gap between the front end and the gripping wall; wherein the front end is configured to exert a pressure force on the lace when the turning gate is turned backwards; wherein the front end is pressuring the lace against the surface of the gripping wall;

wherein, the front end is configured to increase the pressure force on the lace when the turning gate is turned increasingly backwards, and the front end is configured to reduce the pressure force on the lace when the turning gate is turned increasingly forwards;

at the active state, the front end is configured to exert said pressure force on the lace and the front end is configured to frictionally engage the lace and to turn forwards the turning gate when the lace is translated in said forwards direction; also, at the active state the front end is configured to frictionally engage the lace and to turn backwards the turning gate when the lace is translated in said backwards direction;

wherein, forwards translation of the lace is facilitated by turning increasingly forwards the turning gate and consequently diminishing the pressure force of the front end on the lace; whereas backwards translation of the lace is restricted by turning increasingly backwards the turning gate and consequently increasing the pressure force of the front end on the lace;

at the inactive state of the ratcheting device, the front end is configured not to exert said pressure force on the lace and the lace translation is facilitated both in the forwards direction and in the backwards direction;

the spring is preloaded and configured to apply a backwards turning force on the turning gate causing the front end to apply said pressure force on the lace;

the rear end is being configured as a lever for manually turning the turning gate forwards and diminishing the pressure force exerted by the front end on the lace; wherein, releasing the lace;

wherein the ratcheting device further comprising one or more bulges disposed on the surface of the gripping wall; wherein said bulge is configured to cause an additional bending of the lace due to said pressure force; wherein, said additional bending increases a mutual friction force between the lace and the surface when said ratcheting device is in said active state and said lace is pulled in said backwards direction.

7. A ratcheting device for releasably fastening a lace, the ratcheting device comprising:

a lace, and a channel being configured to receive a portion of the lace therethrough;

said channel further includes a gripping wall being adapted with a surface configured to engage said lace;

the ratcheting device has an active state and an inactive state; wherein in said active state the ratcheting device is configured to restrict translation of the lace in the channel in a backwards direction and to facilitate translation of the lace in the channel in a forwards direction;

wherein in said inactive state the ratcheting device is configured to facilitate translation of the lace both in said forwards direction and in said backwards direction;

the ratcheting device further comprising:

a turning gate, and a spring;

the turning gate being rotationally engaged with the channel at a fulcrum, wherein the turning gate comprises a front end and a rear end opposite the front end;

the turning gate is installed at a diagonal orientation with respect to the forwards direction; the front end is disposed diagonally opposite the gripping wall within the channel; wherein the lace is configured to pass through a gap between the front end and the gripping wall; wherein the front end is configured to exert a pressure force on the lace when the turning gate is turned backwards; wherein the front end is pressuring the lace against the surface of the gripping wall;

wherein, the front end is configured to increase the pressure force on the lace when the turning gate is turned increasingly backwards, and the front end is configured to reduce the pressure force on the lace when the turning gate is turned increasingly forwards;

at the active state, the front end is configured to exert said pressure force on the lace and the front end is configured to frictionally engage the lace and to turn forwards the turning gate when the lace is translated in said forwards direction; also, at the active state the front end is configured to frictionally engage the lace and to turn backwards the turning gate when the lace is translated in said backwards direction;

wherein, forwards translation of the lace is facilitated by turning increasingly forwards the turning gate and consequently diminishing the pressure force of the front end on the lace; whereas backwards translation of the lace is restricted by turning increasingly backwards the turning gate and consequently increasing the pressure force of the front end on the lace;

at the inactive state of the ratcheting device, the front end is configured not to exert said pressure force on the lace and the lace translation is facilitated both in the forwards direction and in the backwards direction;

the spring is preloaded and configured to apply a backwards turning force on the turning gate causing the front end to apply said pressure force on the lace;

the rear end is being configured as a lever for manually turning the turning gate forwards and diminishing the pressure force exerted by the front end on the lace; wherein, releasing the lace;

wherein said spring is a torsion spring; the torsion spring has a resilient helical wire structure with a first wire end and a second wire end; wherein said torsion spring is installed preloaded with a bias which applies said backwards turning force on the turning gate;

wherein said ratcheting device further comprising a rear spring support; said rear spring support further comprising: a rear pin attached to said channel; wherein said first wire end is supported by said rear pin; wherein said second wire end is supported by said turning gate.

8. A ratcheting device for releasably fastening a lace, the ratcheting device comprising:

a lace, and a channel being configured to receive a portion of the lace therethrough;

said channel further includes a gripping wall being adapted with a surface configured to engage said lace;

the ratcheting device has an active state and an inactive state; wherein in said active state the ratcheting device is configured to restrict translation of the lace in the channel in a backwards direction and to facilitate translation of the lace in the channel in a forwards direction;

wherein in said inactive state the ratcheting device is configured to facilitate translation of the lace both in said forwards direction and in said backwards direction;

the ratcheting device further comprising:

a turning gate, and a spring;

the turning gate being rotationally engaged with the channel at a fulcrum, wherein the turning gate comprises a front end and a rear end opposite the front end;

the turning gate is installed at a diagonal orientation with respect to the forwards direction; the front end is disposed diagonally opposite the gripping wall within the channel; wherein the lace is configured to pass through a gap between the front end and the gripping wall; wherein the front end is configured to exert a pressure force on the lace when the turning gate is turned backwards; wherein the front end is pressuring the lace against the surface of the gripping wall;

wherein, the front end is configured to increase the pressure force on the lace when the turning gate is turned increasingly backwards, and the front end is configured to reduce the pressure force on the lace when the turning gate is turned increasingly forwards;

at the active state, the front end is configured to exert said pressure force on the lace and the front end is configured to frictionally engage the lace and to turn forwards the turning gate when the lace is translated in said forwards direction; also, at the active state the front end is configured to frictionally engage the lace and to turn backwards the turning gate when the lace is translated in said backwards direction;

wherein, forwards translation of the lace is facilitated by turning increasingly forwards the turning gate and consequently diminishing the pressure force of the front end on the lace; whereas backwards translation of the lace is restricted by turning increasingly backwards the turning gate and consequently increasing the pressure force of the front end on the lace;

at the inactive state of the ratcheting device, the front end is configured not to exert said pressure force on the lace and the lace translation is facilitated both in the forwards direction and in the backwards direction;

the spring is preloaded and configured to apply a backwards turning force on the turning gate causing the front end to apply said pressure force on the lace;

the rear end is being configured as a lever for manually turning the turning gate forwards and diminishing the pressure force exerted by the front end on the lace;

wherein, releasing the lace;

wherein said spring is a torsion spring; the torsion spring has a resilient helical wire structure with a first wire end and a second wire end; wherein said torsion spring is installed preloaded with a bias which applies said backwards turning force on the turning gate;

wherein said ratcheting device further comprising a front spring support; wherein said first wire end is supported by said channel and said second wire end is supported by said turning gate.

9. The ratcheting device of claim 1, wherein said lace further comprises a first lace end and a second lace end; wherein said ratcheting device is configured for single said lace fastening by tying said first lace end to said ratcheting device and fastening said second lace end with said ratcheting device; wherein, when the lace is fastened, said first lace end pulls said ratcheting device in said forwards direction, while said lace ratcheting device is also being pulled in said backwards direction by said second lace end.

10. A ratcheting system for releasably fastening two laces and thereby achieving a secure attachment of an article about a person or an object, the ratcheting system comprising: a first ratcheting device and a second ratcheting device; the first ratcheting device further comprising:

a first lace, and a first channel being configured to receive a portion of the first lace therethrough;

said first channel further includes a first gripping wall being adapted with a first surface configured to engage said first lace;

the first ratcheting device has a first active state and a first inactive state;

wherein in said first active state the first ratcheting device is configured to restrict translation of the first lace in the first channel in a first backwards direction and to facilitate translation of the first lace in the first channel in a first forwards direction;

wherein in said first inactive state the first ratcheting device is configured to facilitate translation of the first lace both in said first forwards direction and in said first backwards direction;

the first ratcheting device further comprising:

a first turning gate, and a first spring;

the first turning gate being rotationally engaged with the first channel at a first fulcrum, wherein the first turning gate comprises a first front end and a first rear end opposite the first front end;

the first turning gate is installed at a first diagonal orientation with respect to the first forwards direction; the first front end is disposed diagonally opposite the first gripping wall within the first channel; wherein the first lace is configured to pass through a first gap between the first front end and the first gripping wall; wherein the first front end is configured to exert a first pressure force on the first lace when the first turning gate is turned first backwards; wherein the first front end is pressuring the first lace against the first surface of the first gripping wall;

wherein, the first front end is configured to increase the first pressure force on the first lace when the first turning gate is turned increasingly first backwards, and the first front end is configured to reduce the first pressure force on the first lace when the first turning gate is turned increasingly first forwards;

at the first active state the first front end is configured to exert said first pressure force on the first lace and the first front end is configured to frictionally engage the first lace and to turn first forwards the first turning gate when the first lace is translated in said first forwards direction; also, at the first active state the first front end is configured to frictionally engage the first lace and to turn first backwards the first turning gate when the first lace is translated in said first backwards direction;

wherein, the first forwards translation of the first lace is facilitated by turning increasingly forwards the first turning gate and consequently diminishing the first pressure force of the first front end on the first lace; whereas backwards translation of the first lace is restricted by turning increasingly backwards the first turning gate and consequently increasing the first pressure force of the first front end on the first lace;

at the first inactive state of the first ratcheting device the first front end is configured not to exert said first pressure force on the first lace; wherein the first lace translation is facilitated both in the first forwards direction and in the first backwards direction;

the first spring is preloaded and configured to apply a first backwards turning force on the first turning gate causing the first front end to apply said first pressure force on the first lace;

the first rear end is being configured as a first lever for manually turning the first turning gate first forwards and diminishing the first pressure force exerted by the first front end on the first lace; wherein, releasing the first lace;

the second ratcheting device further comprising:

a second lace, and a second channel being configured to receive a portion of the second lace therethrough;

said second channel further includes a second gripping wall being adapted with a second surface configured to engage said second lace;

the second ratcheting device has a second active state and a second inactive state; wherein in said second active state the second ratcheting device is configured to restrict translation of the second lace in the second channel in a second backwards direction and to facilitate translation of the second lace in the second channel in a second forwards direction;

wherein in said second inactive state the second ratcheting device is configured to facilitate translation of the second lace both in said second forwards direction and in said second backwards direction;

the second ratcheting device further comprising:

a second turning gate, and a second spring;

the second turning gate being rotationally engaged with the second channel at a second fulcrum, wherein the second turning gate comprises a second front end and a second rear end opposite the second front end;

the second turning gate is installed at a second diagonal orientation with respect to the second forwards direction; the second front end is disposed diagonally opposite the second gripping wall within the second channel; wherein the second lace is configured to pass through a second gap between the second front end and the second gripping wall; wherein the second front end is configured to exert a second pressure force on the second lace when the second turning gate is turned second backwards; wherein the second front end is pressuring the second lace against the second surface of the second gripping wall;

wherein, the second front end is configured to increase the second pressure force on the second lace when the second turning gate is turned increasingly second backwards, and the second front end is configured to reduce the second pressure force on the second lace when the second turning gate is turned increasingly second forwards;

at the second active state the second front end is configured to exert said second pressure force on the second lace and the second front end is configured to frictionally engage the second lace and to turn second forwards the second turning gate when the second lace is translated in said second forwards direction; also, at the second active state the second front end is configured to frictionally engage the second lace and to turn second backwards the second turning gate when the second lace is translated in said second backwards direction;

wherein the second forwards translation of the second lace is facilitated by turning increasingly forwards the second turning gate and consequently diminishing the second pressure force of the second front end on the second lace; whereas backwards translation of the second lace is restricted by turning increasingly backwards the second turning gate and consequently increasing the second pressure force of the second front end on the second lace;

at the second inactive state of the second ratcheting device the second front end is configured not to exert said second pressure force on the second lace; thereby, the second lace translation is facilitated both in the second forwards direction and in the second backwards direction;

the second spring is preloaded and configured to apply a second backwards turning force on the second turning gate causing the second front end to apply said second pressure force on the second lace;

the second rear end is being configured as a second lever for manually turning the second turning gate second forwards and diminishing the second pressure force exerted by the second front end on the second lace; wherein, releasing the second lace.

11. The ratcheting system of claim 10, wherein said first fulcrum comprises a first axle which is fitted in a first bearing;

wherein said second fulcrum comprises a second axle which is fitted in a second bearing.

12. The ratcheting system of claim 10, wherein said first spring is a first torsion spring; the first torsion spring has a first resilient helical wire structure with a first front wire end and a first rear wire end; wherein said first torsion spring is installed preloaded with a first bias which is configured to apply said first backwards turning force on the first turning gate; wherein said second spring is a second torsion spring; the second torsion spring has a second resilient helical wire structure with a second front wire end and a second rear wire end; wherein said second torsion spring is installed preloaded with a second bias which is configured to apply said second backwards turning force on the second turning gate.

13. The ratcheting system of claim 10, wherein said first front end comprises a first tapered edge and a first smooth side; wherein, the first tapered edge is configured to concentrate said first pressure force when the first turning gate is turned backwards and the first front end engages the first lace; wherein, the first smooth side is configured to engage the first lace when the first turning gate is turned forwards; wherein, the first smooth side is configured to reduce said first lace wear when the first lace is translated in the first forwards direction;

wherein said second front end comprises a second tapered edge and a second smooth side; wherein, the second tapered edge is configured to concentrate said second pressure force when the second turning gate is turned backwards and the second front end engages the second lace; wherein, the second smooth side is configured to engage the second lace when the second turning gate is turned forwards; wherein, the second smooth side is configured to reduce said second lace wear when the second lace is translated in the second forwards direction.

14. The ratcheting system of claim 10, wherein the first surface of the first gripping wall comprises a first smooth surface; wherein, the first smooth surface is configured to reduce said first lace wear when the first lace is fastened at said first active state and also when said first lace is translated in said first inactive state;

wherein the second surface of the second gripping wall comprises a second smooth surface; wherein, the second smooth surface is configured to reduce said second lace wear when the second lace is fastened at said second active state and also when said second lace is translated in said second inactive state.

15. The ratcheting system of claim 10, wherein the first ratcheting device further comprises a first bulge disposed on the first surface of the first gripping wall; wherein said first bulge is configured to cause a first additional bending of the first lace due to said first pressure force; wherein, said first additional bending is configured to increase a first mutual friction force between the first lace and the first surface when said first ratcheting device is in said first active state and said first lace is pulled in said first backwards direction;

wherein the second ratcheting device further comprises a second bulge disposed on the second surface of the second gripping wall; wherein said second bulge is configured to cause a second additional bending of the second lace due to said second pressure force; wherein, said second additional bending is configured to increase a second mutual friction force between the second lace and the second surface when said second ratcheting device is in said second active state and said second lace is pulled in said second backwards direction.

16. The ratcheting system of claim 12, wherein said first ratcheting device further comprising a first rear spring support; wherein the first rear spring support further comprising: a first rear pin attached to said first channel;

wherein said first rear wire end is supported by said first rear pin; wherein said first front wire end is supported by said first turning gate;

said second ratcheting device further comprising a second rear spring support;

wherein, the second rear spring support further comprising: a second rear pin attached to said second channel; wherein said second rear wire end is supported by said second rear pin; wherein said second roar wire end is supported by said second turning gate.

17. The ratcheting system of claim 12, wherein said first ratcheting device further comprising a first front spring support; wherein, said first front wire end is supported by said first channel and said first rear wire end is supported by said first turning gate;

wherein said second ratcheting device further comprising a second front spring support; wherein, said second front wire end is supported by said second channel and said second rear wire end is supported by said second turning gate.

18. The ratcheting system of claim 10, wherein the first channel further comprising a first top wall opposite the first gripping wall and the second channel further comprising a second top wall opposite the second gripping wall; wherein said first ratcheting device and said second ratcheting device are coupled in a parallel configuration by attaching the first gripping wall to the second gripping wall; wherein the first lever is configured to protrude from a first opening in the first top wall which is situated on a first outer side of said parallel configuration and the second lever is configured to protrude from a second opening in the second top wall which is situated opposite to the first top wall on a second outer side of said parallel configuration; wherein, having the first lever opposite to the second lever facilitates single handed manual operation.

19. The ratcheting system of claim 10, wherein the first channel further comprising a first top wall opposite the first gripping wall and the second channel further comprising a second top wall opposite the second gripping wall; wherein said first ratcheting device and said second ratcheting device are rotatably engaged in a triangular configuration by rotatably hinging said first ratcheting device on a connecting plate using a first hinge and rotatably hinging said second ratcheting device on the connecting plate using a second hinge;

wherein in said triangular configuration the first gripping wall and the second gripping wall form two sides of a triangle, which are joined at said connecting plate;

wherein the first lever which is configured to protrude from a first opening in the first top wall, is configured to engage at the center of the triangle with the second lever which is configured to protrude from a second opening in the second top wall; wherein the first lever is configured to press the second lever when opposing manual pressures are applied on the first gripping wall and on the second gripping wall.

20. The ratcheting system of claim 10, wherein said first channel further comprising: a first entry opening and a first lower side wall; the first lower side wall adjacent to the first entry opening comprises a first rear segment of the first lower side wall preceded by a first recess situated in front of said first rear segment of the first lower side wall; wherein said first lace is configured to enter said first channel via said first recess; wherein, when said first lace is fastened on a footwear, said first lace is configured to apply a first downwards force on said first recess; wherein said first downwards force is naturally countered in the opposite direction by a first reaction upwards force configured to be applied by the footwear on said first rear segment; said first downwards force and said first reaction upwards force create a first moment of force which tends to turn said first ratcheting device towards said footwear;

wherein, said first moment of force is configured to clutch said first ratcheting device on top of said footwear;

wherein said second channel further comprising: a second entry opening and a second lower side wall; the second lower side wall adjacent to the second entry opening comprises a second rear segment of the second lower side wall preceded by a second recess situated in front of said second rear segment of the second lower side wall; wherein said second lace is configured to enter said second channel via said second recess; wherein, when said second lace is fastened on a footwear, said second lace is configured to apply a second downwards force on said second recess; wherein said second downwards force is naturally countered in the opposite direction by a second reaction upwards force configured to be applied by the footwear on said second rear segment; said second downwards force and said second reaction upwards force create a second moment of force which tends to turn said second ratcheting device towards said footwear;

wherein, said second moment of force is configured to clutch said second ratcheting device on top of said footwear.

21. The ratcheting system of claim 10, wherein said first ratcheting device is installed at a first side of an article and said first lace comprises of a first end of a single lace;

wherein said second ratcheting device is installed at a second side of the article and said second lace comprises of a second end of the single lace;

wherein, a secure attachment of the article about the person or the object is achieved by fastening the first end of the single lace by said first ratcheting device and by fastening the second end of the single lace by said second ratcheting device.

22. A lace clasp for clasping two or more laces, further comprising:

an arm, a u-shaped channel and a clasp axle;

wherein the arm is rotationally installed inside said u-shaped channel using the clasp axle as a pivot; wherein the arm is made of solid material and the u-shaped channel is made of elastic material;

the u-shaped channel comprises:

two parallel walls connected at their bottom;

wherein the two parallel walls further comprising:

a first wall opposite to a second wall, a first wall opening opposite to a second wall opening;

the arm comprises: a first wedge protrusion opposite to a second wedge protrusion; wherein the first wedge protrusion is configured to fit into the first wall opening and the second wedge protrusion is configured to fit into the second wall opening;

the lace clasp has two positions:

an unlocked position and a locked position; wherein at the unlocked position the arm is turned at an angle above the u-shaped channel; wherein the angle is greater than 15 degrees; wherein at the locked position the arm is turned into the u-shaped channel; wherein at locked position the first wedge protrusion is configured to be inserted into the first wall opening and the second wedge protrusion is configured to be inserted into the second wall opening; wherein, holding the arm at locked position; wherein during locked position the arm is squeezing into the u-shaped channel the two or more laces which were put under the arm at the unlocked position;

wherein, at the locked position, the lace clasp is clasping together the two or more laces;

whereby, at the locked position the lace clasp can be anchored to an object to reduce dangling of the laces.

* * * * *